US011982143B2

(12) United States Patent
Ducamin et al.

(10) Patent No.: US 11,982,143 B2
(45) Date of Patent: May 14, 2024

(54) COMMUNICATING WITH BLOWOUT PREVENTER CONTROL SYSTEM

(71) Applicant: Schlumberger Technology Corporation, Sugar Land, TX (US)

(72) Inventors: Eric Ducamin, Katy, TX (US); Joergen Kringen Johnsen, Kristiansand (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/653,228

(22) Filed: Mar. 2, 2022

(65) Prior Publication Data

US 2022/0282587 A1 Sep. 8, 2022

Related U.S. Application Data

(60) Provisional application No. 63/155,438, filed on Mar. 2, 2021.

(51) Int. Cl.

| | |
|---|---|
| ***E21B 21/08*** | (2006.01) |
| ***E21B 33/06*** | (2006.01) |
| ***E21B 47/06*** | (2012.01) |

(52) U.S. Cl.

CPC ..... *E21B 21/08* (2013.01); *E21B 33/061* (2013.01); *E21B 47/06* (2013.01)

(58) Field of Classification Search

CPC ..... E21B 21/08; E21B 33/061; E21B 47/06; E21B 34/16; E21B 21/00; E21B 21/082; E21B 21/085; E21B 33/06

See application file for complete search history.

(56) References Cited

U.S. PATENT DOCUMENTS

| | | | | |
|---|---|---|---|---|
| 10,329,860 | B2 | 6/2019 | Boutalbi et al. | |
| 2018/0058195 | A1* | 3/2018 | Clark | E21B 33/035 |
| 2019/0368299 | A1* | 12/2019 | Jorud | E21B 34/066 |
| 2020/0318464 | A1 | 10/2020 | Atchison et al. | |

FOREIGN PATENT DOCUMENTS

| | | | | |
|---|---|---|---|---|
| WO | WO-2019050824 A1 * | 3/2019 | | E21B 3/02 |

* cited by examiner

*Primary Examiner* — Caroline N Butcher
(74) *Attorney, Agent, or Firm* — Kelly McKinney

(57) ABSTRACT

Systems and methods for communicating with a blowout preventer (BOP) control system. An example system includes a pressure control system for controlling a pressure control manifold fluidly connected with the wellbore and a BOP control system for controlling BOP equipment. The pressure control system may include a sensor operable to output pressure data indicative of wellbore pressure. The BOP control system may include a sensor operable to output BOP data indicative of operational status of the BOP equipment and a BOP human-machine interface (HMI) usable by a human user to monitor and control the BOP equipment. The BOP control system may be communicatively connected with the pressure control system, receive the pressure data, and display, on the BOP HMI, information based on the pressure data.

20 Claims, 4 Drawing Sheets

COMMUNICATING WITH BLOWOUT PREVENTER CONTROL SYSTEM

CROSS-REFERENCE TO RELATED APPLICATION

This application claims priority to and the benefit of U.S. Provisional Application No. 63/155,438, filed on Mar. 2, 2021, the entirety of which is incorporated herein by reference.

BACKGROUND OF THE DISCLOSURE

Wells extend into the ground or ocean bed to facilitate recovery of natural deposits of oil, gas, and other materials that are trapped in subterranean geological formations. Well construction (e.g., drilling) operations may be performed at a wellsite by a well construction system (e.g., a drilling rig) having various surface and subterranean well construction equipment operating in a coordinated manner. For example, a drive mechanism, such as a top drive located at a wellsite surface, may be utilized to rotate and advance a drill string into the subterranean formation to drill a wellbore. The drill string may include a plurality of drill pipes coupled together and terminating with a drill bit. Length of the drill string may be increased by adding additional drill pipes as depth of the wellbore increases. Drilling fluid may be pumped from the wellsite surface down through the drill string to the drill bit. The drilling fluid lubricates and cools the drill bit and carries drill cuttings from the wellbore to the wellsite surface. The drilling fluid returning to the wellsite surface may then be cleaned and again pumped through the drill string. The well construction equipment of the well construction system may be grouped into various subsystems, wherein each subsystem performs a different operation.

The well construction equipment includes rig equipment for performing drilling operations to drill the wellbore at the wellsite surface and safety equipment for controlling pressure of the drilling fluid (and formation fluid) within the wellbore being drilled by the rig equipment. The safety equipment includes blowout preventer (BOP) equipment selectively operable to block the opening of the wellbore at the wellsite surface to therefore prevent or inhibit flow of the drilling fluid out of the wellbore. The rig equipment is controlled (or operated) by or via a rig control system and the BOP equipment is controlled by or via a BOP control system. The BOP control system can be used to manually control the BOP equipment by rig personnel and/or the BOP control system can automatically control the BOP equipment based on predetermined programming and sensor data facilitated by BOP sensors disposed in association with the BOP equipment. The sensor data facilitated by the BOP sensors provides limited information to the BOP control system and the rig personnel using the BOP control system. Such limited information can result in the BOP control system or the rig personnel controlling the BOP equipment in a less than optimal manner or in a manner that can damage the BOP equipment. Sensor data facilitated by rig sensors disposed in association with the rig equipment provides a wide range of information to the rig control system. However, the BOP control system is not communicatively connected with the rig control system or the rig sensors and, thus, the BOP control system does not have access to the sensor data facilitated by rig sensors.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a system including a pressure control system and a BOP control system. The pressure control system controls a pressure control manifold fluidly connected with a wellbore. The pressure control system includes a sensor operable to output pressure data indicative of wellbore pressure. The BOP control system controls BOP equipment. The BOP control system includes a sensor operable to output BOP data indicative of operational status of the BOP equipment. The BOP control system also includes a BOP human-machine interface (HMI) usable by a human user to monitor and control the BOP equipment. The BOP control system is communicatively connected with the pressure control system and receives the pressure data. The BOP control system also displays, on the BOP HMI, information based on the pressure data.

The present disclosure also introduces a system including a rig control system and a BOP control system. The rig control system controls rig equipment operable to perform drilling operations to drill a wellbore at a wellsite. The rig control system includes sensors operable to output rig data indicative of operational status of the rig equipment. The rig control system also includes a pressure control system for controlling a pressure control manifold fluidly connected with the wellbore. The pressure control system includes a sensor operable to output pressure data indicative of wellbore pressure. The BOP control system controls BOP equipment. The BOP control system includes a sensor operable to output BOP data indicative of operational status of the BOP equipment. The BOP control system also includes a BOP HMI usable by a human user to monitor and control the BOP equipment. The BOP control system is communicatively connected with the rig control system and the pressure control system and receives the rig data and the pressure data. The BOP control system also displays, on the BOP HMI, information based on the rig data and the pressure data.

The present disclosure also introduces a system including a BOP control system and a health monitoring system. The BOP control system controls BOP equipment at a wellsite and includes a sensor operable to output BOP data indicative of operational status of the BOP equipment. The health monitoring system is communicatively connected with the BOP control system. The health monitoring system records the BOP data to a memory and determines operational health of the BOP equipment based on the BOP data.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
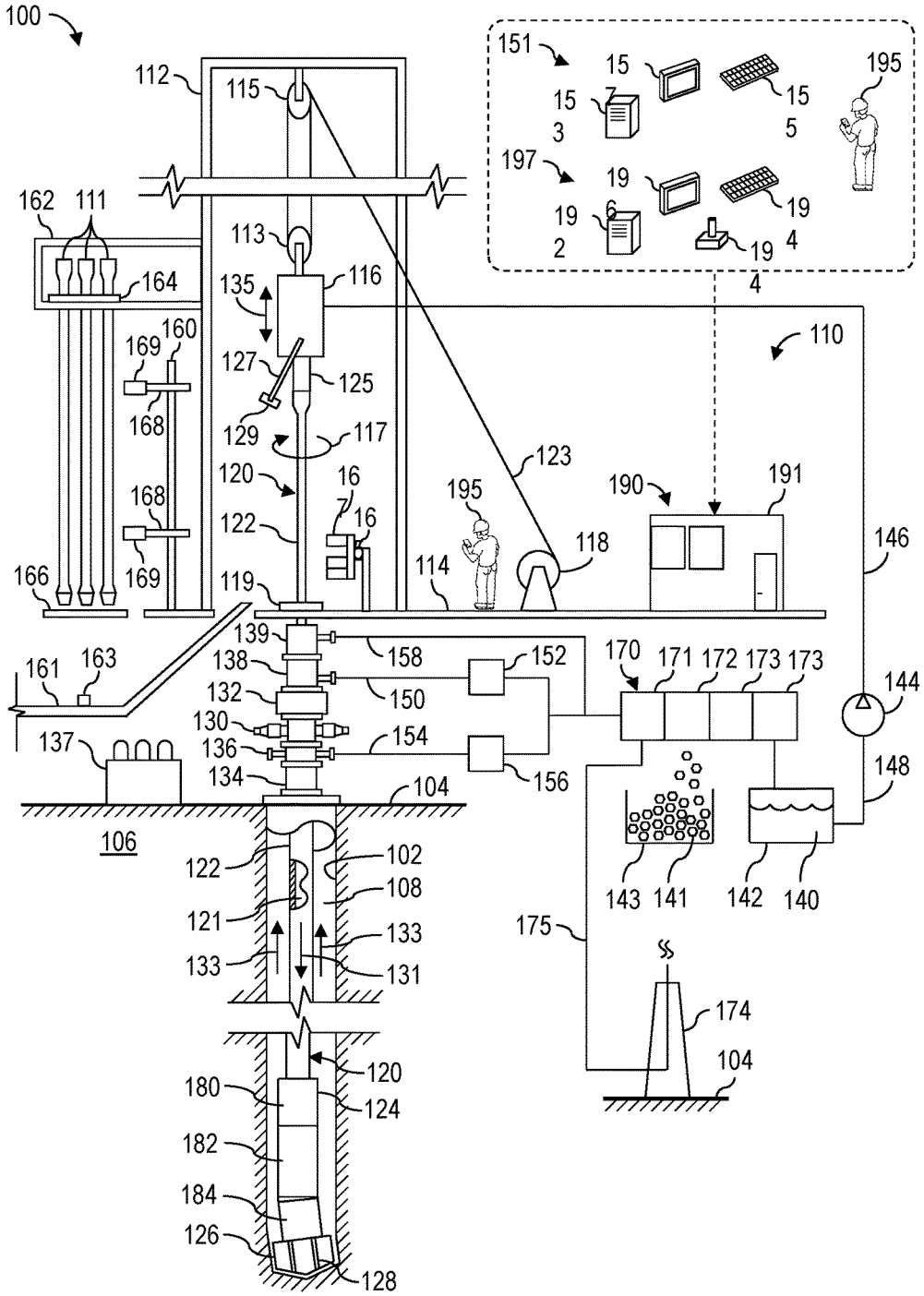
FIG. 1 is a schematic side view of at least a portion of an example implementation of apparatus according to one or more aspects of the present disclosure.

It is to be understood that the following disclosure describes many example implementations for different aspects introduced herein. Specific examples of components and arrangements are described below to simplify the present disclosure. These are merely examples, and are not intended to be limiting. In addition, the present disclosure may repeat reference numerals and/or letters in the various examples. This repetition is for simplicity and clarity, and does not in itself dictate a relationship between the various implementations described herein. Moreover, the formation of a first feature over or on a second feature in the description that follows may include implementations in which the first and second features are formed in direct contact, and may also include implementations in which additional features may be formed interposing the first and second features, such that the first and second features may not be in direct contact.

Systems and methods (e.g., processes, operations, etc.) according to one or more aspects of the present disclosure may be utilized or otherwise implemented in association with an automated well construction system (i.e., well construction rig) at an oil and gas wellsite, such as for constructing a well (including drilling a wellbore) for extracting hydrocarbons (e.g., oil and/or gas) from a subterranean formation. FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction (e.g., drilling) rig and associated well construction equipment. Although the well construction system 100 is depicted as an onshore implementation, the aspects described below are also applicable or readily adaptable to offshore implementations.

The well construction system 100 is depicted in relation to a wellbore 102 formed by rotary and/or directional drilling from a wellsite surface 104 and extending into a subterranean formation 106. The well construction system 100 comprises or is associated with various well construction equipment (i.e., wellsite equipment), including surface equipment 110 located at the wellsite surface 104 and a drill string 120 suspended within the wellbore 102. The surface equipment 110 may include a mast, a derrick, and/or other support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown).

The drill string 120 may comprise a bottom-hole assembly (BHA) 124 and means 122 for conveying the BHA 124 within the wellbore 102. The conveyance means 122 may comprise a plurality of interconnected tubulars, such as drill pipe, heavy-weight drill pipe (HWDP), wired drill pipe (WDP), tough logging condition (TLC) pipe, and drill collars, among other examples. The conveyance means 122 may instead comprise coiled tubing for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated from the wellsite surface 104 and/or via a downhole mud motor 184 connected with the drill bit 126. The BHA 124 may also include various downhole devices and/or tools 180, 182.

The support structure 112 may support a driver, such as a top drive 116, operable to connect with an upper end of the drill string 120, and to impart rotary motion 117 and vertical motion 135 to the drill string 120, including the drill bit 126. However, other drivers, such as a kelly and rotary table (neither shown), may be utilized instead of or in addition to the top drive 116 to impart the rotary motion 117 to the drill string 120. The top drive 116 and the connected drill string 120 may be suspended from the support structure 112 via hoisting equipment, which may include a traveling block 113, a crown block 115, and a drawworks 118 storing a support cable or line 123. The crown block 115 may be connected to or otherwise supported by the support structure 112, and the traveling block 113 may be coupled with the top drive 116. The drawworks 118 may be mounted on or otherwise supported by the rig floor 114. The crown block 115 and traveling block 113 comprise pulleys or sheaves around which the support line 123 is reeved to operatively connect the crown block 115, the traveling block 113, and the drawworks 118 (and perhaps an anchor). The drawworks 118 may thus selectively impart tension to the support line 123 to lift and lower the top drive 116, resulting in the vertical motion 135. The drawworks 118 may comprise a drum, a base, and an actuator (e.g., an electric motor) (not shown) operable to drive the drum to rotate and reel in the support line 123, causing the traveling block 113 and the top drive 116 to move upward. Similarly, the drawworks 118 is operable to reel out the support line 123 via controlled rotation of the drum, causing the traveling block 113 and the top drive 116 to move downward.

The top drive 116 may comprise a grabber, a swivel (neither shown), elevator links 127 terminating with an elevator 129, and a drive shaft 125 operatively connected with a rotary actuator (e.g., an electric motor) (not shown), such as via a gear box or transmission (not shown). The drive shaft 125 may be selectively coupled with the upper end of the drill string 120 and the rotary actuator may be selectively operated to rotate the drive shaft 125 and the drill string 120 coupled with the drive shaft 125. Thus, during drilling operations, the top drive 116, in conjunction with operation of the drawworks 118, may advance the drill string 120 into the formation 106 to form the wellbore 102. The elevator links 127 and the elevator 129 of the top drive 116 may handle tubulars (e.g., singles or stands of drill pipe, drill collars, casing joints, etc.) that are not mechanically coupled to the drive shaft 125.

The drill string 120 may be conveyed within the wellbore 102 through various fluid control equipment (or devices) disposed at the wellsite surface 104 over an opening of the wellbore 102 and perhaps below the rig floor 114. The fluid control equipment may be operable to control fluid within the wellbore 102. The fluid control equipment may include a BOP ram stack 130 and an annular preventer 132 for maintaining well pressure control. The fluid control equipment may also include a rotating control device (RCD) 138 mounted above the annular preventer 132. The BOP ram stack 130, the annular preventer 132, and the RCD 138 may each comprise one or more fluid barriers (e.g., annular packing elements, rams, etc.) selectively operable to block, limit, or otherwise control flow of drilling fluid (and formation fluid) out of the wellbore 102. The fluid control equipment 130, 132, 138 may be mounted on top of a wellhead 134. The drilling fluid may exit the wellbore via the RCD 138, via a ported adapter 136 (e.g., a spool, cross adapter, a wing valve, etc.) located below one or more of the fluid control equipment 130, 132, 138, or via a bell nipple 139 located above one or more of the fluid control equipment 130, 132, 138.

A power unit 137 (i.e., a BOP control or closing unit) may be operatively connected with one or more of the fluid control equipment 130, 132, 138 and operable to actuate, drive, operate, or otherwise control one or more of the fluid control equipment 130, 132, 138. The power unit 137 may be or comprise a hydraulic fluid power unit fluidly connected with the fluid control equipment 130, 132, 138 and selectively operable to hydraulically drive (e.g., open, close, etc.) various portions (e.g., rams, valves, seals) of the fluid control equipment 130, 132, 138. The power unit 137 may comprise one or more hydraulic pumps actuated by electric motors and operable to pressurize hydraulic fluid stored in hydraulic accumulators for operating the fluid control equipment 130, 132, 138.

The well construction system 100 may further include drilling fluid circulation equipment operable to circulate fluids between the surface equipment 110 and the drill bit 126 during drilling and other operations. For example, the drilling fluid circulation equipment may be operable to inject a drilling fluid from the wellsite surface 104 into the wellbore 102 via an internal fluid passage 121 extending longitudinally through the drill string 120. The drilling fluid circulation equipment may comprise a pit, a tank, and/or other fluid container 142 holding the drilling fluid 140 (i.e., drilling mud), and one or more mud pump units 144 (i.e., drilling fluid pumps) operable to move the drilling fluid 140 from the container 142 into the fluid passage 121 of the drill string 120 via a fluid conduit 146 extending from the pump units 144 to the top drive 116 and an internal passage extending through the top drive 116. Each pump unit 144 may comprise a fluid pump (not shown) operable to pump the drilling fluid 140 and a rotary actuator (e.g., an electric motor) (not shown) operable to drive the corresponding fluid pump. The fluid conduit 146 may comprise one or more of a pump discharge line, a stand pipe, a rotary hose, and a gooseneck connected with a fluid inlet of the top drive 116. The pumps 144 and the container 142 may be fluidly connected by a fluid conduit 148, such as a suction line.

During drilling operations, the drilling fluid may continue to flow downhole through the internal passage 121 of the drill string 120, as indicated by directional arrow 131. The drilling fluid may exit the BHA 124 via ports 128 in the drill bit 126 and then circulate uphole through a wellbore annulus 108 of the wellbore 102 defined between an outer surface of the drill string 120 and a sidewall of the wellbore 102, such flow being indicated by directional arrows 133. In this manner, the drilling fluid lubricates the drill bit 126 and carries formation cuttings uphole to the wellsite surface 104. The returning drilling fluid may exit the wellbore annulus 108 via different fluid control equipment during different stages or scenarios of well drilling operations. For example, the drilling fluid may exit the wellbore annulus 108 via the bell nipple 139, the RCD 138, or the ported adapter 136.

During normal drilling operations (e.g., when the well is overbalanced), the drilling fluid may exit the wellbore annulus 108 via the bell nipple 139 and then be directed toward drilling fluid reconditioning equipment 170 via a fluid conduit 158 (e.g., gravity return line) to be cleaned and/or reconditioned, as described below, before being returned to the container 142 for recirculation. During managed pressure drilling (MPD) operations (e.g., when the well is underbalanced), the drilling fluid may exit the wellbore annulus 108 via the RCD 138 and then be directed into an MPD manifold 152 via a fluid conduit 150 (e.g., a drilling pressure control line). The MPD manifold 152 may include at least one choke and a plurality of fluid valves collectively operable to control the flow of the drilling fluid through and out of the MPD manifold 152. The MPD manifold 152 may generate backpressure that is applied to the upper (i.e., uphole) end of the wellbore annulus 108 to control pressure within the entire wellbore annulus 108 of the wellbore 102 by variably restricting the flow rate of the drilling fluid through the MPD manifold 152 as part of MPD operations. The greater the restriction to flow through the MPD manifold 152, the greater the backpressure applied to the upper end of the wellbore annulus 108 and the greater the pressure along the entire wellbore annulus 108. The drilling fluid exiting the MPD manifold 152 may then pass through the drilling fluid reconditioning equipment 170 before being returned to the container 142 for recirculation.

During well pressure control operations (e.g., during influx of formation fluid into the well), such as when one or more rams of the BOP stack 130 is closed, the drilling fluid may exit the wellbore annulus 108 via the ported adapter 136 and be directed into a choke and kill (CK) manifold (or a rig choke manifold) 156 via a fluid conduit 154 (e.g., a rig choke line). The CK manifold 156 may include at least one choke and a plurality of fluid valves collectively operable to control the flow of the drilling fluid (and perhaps formation fluid) through and out of the CK manifold 156. The CK manifold 156 may variably restrict the flow rate of the drilling fluid through the CK manifold 156 as part of well pressure control operations to thereby facilitate pressure control of the drilling fluid within the wellbore 102. The drilling fluid exiting the CK manifold 156 may then pass through the drilling fluid reconditioning equipment 170 before being returned to the container 142 for recirculation.

Before being returned to the container 142, the drilling fluid returning to the wellsite surface 104 may be cleaned and/or reconditioned via the drilling fluid reconditioning equipment 170, which may include one or more of liquid-gas (i.e., mud gas) separators 171, shale shakers 172, and other drilling fluid cleaning and reconditioning equipment 173. The cleaned and reconditioned drilling fluid may be transferred to the fluid container 142, the solid particles 141 removed from the drilling fluid may be transferred to a solids container 143 (e.g., a reserve pit), and/or the removed gas may be transferred to a flare stack 174 via a conduit 175 (e.g., a flare line) to be burned or to a container (not shown) for storage and removal from the wellsite.

The surface equipment 110 may include tubular handling equipment operable to store, move, connect, and disconnect tubulars (e.g., drill pipe) to assemble and disassemble the conveyance means 122 of the drill string 120 during drilling operations. For example, a catwalk 161 may be utilized to convey tubulars from a ground level (e.g., along the wellsite surface 104) to the rig floor 114, thereby permitting the elevator 129 to grab and lift the tubulars above the wellbore 102 for connection with previously deployed tubulars. The catwalk 161 may have a horizontal portion and an inclined portion that extends between the horizontal portion and the rig floor 114. The catwalk 161 may comprise a skate 163 movable along a groove (not shown) extending longitudinally along the horizontal and inclined portions of the catwalk 161. The skate 163 may be operable to convey (e.g., push) the tubulars along the catwalk 161 to the rig floor 114. The tubular handling equipment may further include a tubular handling manipulator (THM) 160 disposed in association with a vertical pipe rack 162 for storing tubulars 111 (e.g., drill pipe, drill collars, drill pipe stands, casing joints, etc.). The vertical pipe rack 162 may comprise or support a fingerboard 164 defining a plurality of slots configured to support or otherwise hold the tubulars 111 within or above a setback 166 (e.g., a platform) located adjacent to, along, or below the rig floor 114. The THM 160 may be operable to transfer the tubulars 111 between the fingerboard 164/setback 166 and the drill string 120 (i.e., space above the suspended drill string 120). For example, the THM 160 may include arms 168 terminating with clamps 169, such as may be operable to grasp and/or clamp onto one of the tubulars 111. The arms 168 of the THM 160 may extend and retract, and/or at least a portion of the THM 160 may be rotatable and/or movable toward and away from the drill string 120, such as may permit the THM 160 to transfer the tubular 111 between the fingerboard 164/setback 166 and the drill string 120.

Power tongs 165 (e.g., an iron roughneck) may be positioned on the rig floor 114. The power tongs 165 may comprise a torqueing portion 167, such as may include a spinner and a torque wrench comprising a lower tong and an upper tong. The torqueing portion 167 of the power tongs 165 may be moveable toward and at least partially around the drill string 120, such as may permit the power tongs 165 to make up and break out connections of the drill string 120.

A set of slips 119 may be located on the rig floor 114, such as may accommodate therethrough the drill string 120 during tubular make up and break out operations and during drilling operations. The slips 119 may be in an open position during drilling operations to permit advancement of the drill string 120, and in a closed position to clamp the upper end (e.g., the uppermost tubular) of the drill string 120 to thereby suspend and prevent advancement of the drill string 120 within the wellbore 102, such as during the make up and break out operations.

During drilling operations, the various well construction equipment of the well construction system 100 may progress through a plurality of coordinated operations (i.e., operational sequences) to drill or otherwise construct the wellbore 102. The operational sequences may change based on a well construction plan, status of the well, status of the subterranean formation, stage of drilling operations (e.g., tripping, drilling, tubular handling, etc.), and type of downhole tubulars (e.g., drill pipe) utilized, among other examples.

The surface equipment 110 of the well construction system 100 may also comprise a control center 190 from which various portions of the well construction system 100, such as the top drive 116, the hoisting equipment 113, 118, 123, the tubular handling equipment 160, 161, 165, the drilling fluid circulation equipment 142, 144, the drilling fluid reconditioning equipment 170, the pressure control manifolds 152, 156, the fluid control equipment 130, 132, 136, 138, and the BHA 124, among other examples, may be monitored and controlled. The control center 190 may comprise a facility 191 (e.g., a room, a cabin, a trailer, etc.) located on the rig floor 114 or other location of the well construction system 100.

The control center 190 may comprise a central controller 192 (e.g., a processing device, a computer, etc.) located within the facility 191. The central controller 192 may be operable to receive, process, and output information to monitor operations of and control one or more portions of the well construction system 100. For example, the central controller 192 may be communicatively connected with the various surface and downhole equipment described herein, and may be operable to receive signals from and transmit signals to such equipment to perform various automated or semi-automated operations described herein. The central controller 192 may store executable computer program code, instructions, and/or operational parameters or set-points, including for implementing one or more aspects of methods and operations described herein. Although it is possible that the entirety of the central controller 192 is implemented within one device, it is also contemplated that one or more components or functions of the central controller 192 may be implemented across multiple devices, some or an entirety of which may be implemented as part of the control center 190 and/or located within the facility 191.

The control center 190 may comprise a rig control workstation 197 located within the facility 191. The rig control workstation 197 may be operated by rig personnel 195 (e.g., a driller or other human rig operator) to monitor and manually control various well construction equipment or portions of the well construction system 100. The rig control workstation 197 may be communicatively connected with the central controller 192. The rig control workstation 197 may be operable for entering or otherwise communicating control data (e.g., commands, signals, information, etc.) to the central controller 192 and other equipment controllers by the rig personnel 195, and for displaying or otherwise communicating information from the central controller 192 and other equipment controllers to the rig personnel 195. The rig control workstation 197 may be or comprise an HMI, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the central controller 192, the input and output devices 194, 196, and the various well construction equipment may be via wired and/or wireless communication means. However, for clarity and ease of understanding, such communication means are not depicted, and a person having ordinary skill in the art will appreciate that such communication means are within the scope of the present disclosure.

The control center 190 may comprise a BOP controller 153 (e.g., a processing device, a computer, etc.) operable to receive, process, and output data to monitor and control operations of the BOP ram stack 130 and the annular preventer 132 ("BOP equipment"). The BOP controller 153 may be operable to store executable computer program code, instructions, and/or operational parameters or set-points, including for implementing one or more BOP operations described herein. The BOP controller 153 may be operable to control the BOP control unit 137 and, thus, control the BOP equipment 130, 132. For example, the BOP controller 153 may be communicatively connected with the BOP control unit 137 and the BOP equipment 130, 132, and operable to monitor and control operations of the BOP equipment 130, 132 via the BOP control unit 137.

The control center 190 may comprise a BOP control workstation 151 communicatively connected with the BOP controller 153 and operable to receive control commands entered by the rig personnel 195 (e.g., the driller, BOP engineer, etc.) for controlling the BOP equipment 130, 132, to communicate such control commands to the BOP controller 153, and to display or otherwise communicate information indicative of operational status of the BOP equipment 130, 132 and the BOP control unit 137 to the rig personnel 195. The BOP control workstation 151 may be or comprise an HMI, including one or more input devices 155 (e.g., buttons, keys, a touchscreen, etc.) and one or more output devices 157 (e.g., a video monitor, gauges, audio speakers, a touchscreen, etc.). The input and output devices 155, 157 of the BOP control workstation 151 may be disposed in association with and/or integrated within a housing or enclosure and permit the rig personnel 195 to enter commands or other information to the BOP control workstation 151 to control the BOP equipment 130, 132 and receive information from the BOP control workstation 151 to monitor operational status of the BOP equipment 130, 132.

The BOP control workstation 151, the BOP controller 153, and the BOP control unit 137 may be operatively connected via electrical, pneumatic, and/or hydraulic means. However, for clarity and ease of understanding, such communication means are not depicted, and a person having ordinary skill in the art will appreciate that such communication means are within the scope of the present disclosure. For example, control commands output by the BOP controller 153 and/or entered by the rig personnel 195 via the input devices 155 may be transmitted from the BOP control workstation 151 in the form of electrical, pneumatic, and/or hydraulic control signals to operate various portions (e.g., valves) of the BOP control unit 137 to control the BOP equipment 130, 132. Feedback information indicative of operational status of the BOP control unit 137 and the BOP equipment 130, 132 may be transmitted in the form of electrical, pneumatic, and/or hydraulic feedback signals from various sensors of the BOP control unit 137 and the BOP equipment 130, 132 to the BOP control workstation 151 and/or the BOP controller 153. The feedback information may be displayed to the rig personnel 195 via the output devices 157 of the BOP control workstation 151.

The BOP control workstation 151 and the BOP controller 153 may be contained within an intrinsically safe enclosure, an explosion proof enclosure (e.g., Class 1 rating), a weatherproof enclosure, a dust and/or water proof enclosure (e.g., IP66 rating, IP55 rating), and/or may be certified for use in Zone 1, Zone 2, hazardous, and/or safe areas of the wellsite. Although the BOP control workstation 151 and the BOP controller 153 are shown located within the facility 191, the BOP control workstation 151 and/or the BOP controller 153 may be located outside of the facility 191, such as on the rig floor 114 or the wellsite surface 104.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, electric motors, hydraulics, actuators, valves, and/or other components not explicitly described herein may be included in the well construction system 100, and are within the scope of the present disclosure.

Figure 2:
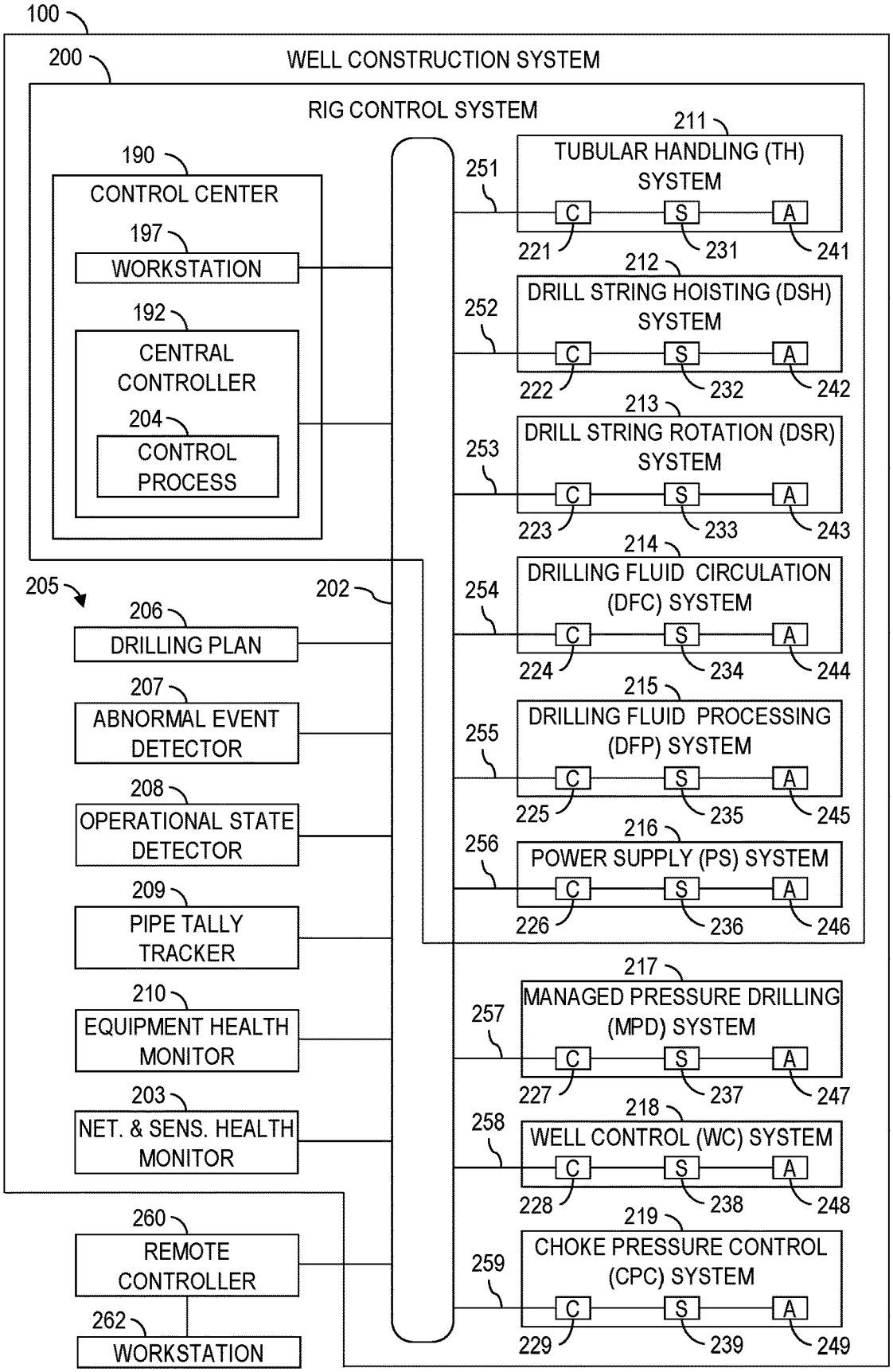
FIG. 2 is a schematic view of at least a portion of an example implementation of apparatus according to one or more aspects of the present disclosure.

The present disclosure further provides various implementations of systems and/or methods for controlling one or more portions of the well construction system 100. FIG. 2 is a schematic view of at least a portion of various control systems and control devices for monitoring and controlling various well construction equipment of the well construction system 100 shown in FIG. 1. Such control systems and devices may comprise one or more features of the well construction system 100, including where indicated by the same reference numerals. Accordingly, the following description refers to FIGS. 1 and 2, collectively.

The well construction equipment of the well construction system 100 may be grouped into several subsystems, each operable to perform a corresponding operation and/or a portion of the well construction operations described herein. For example, the well construction system 100 may comprise a rig drilling operations control system 200 ("rig control system") for monitoring and controlling various operational equipment for performing drilling operations. The rig control system 200 may be operable to control well construction equipment of a tubular handling (TH) system 211, a drill string hoisting system (DSH) system 212, a drill string rotation system (DSR) system 213, a drilling fluid circulation (DFC) system 214, a drilling fluid processing (DFP) system 215, and a power supply (PS) system 216. The well construction system 100 may also comprise a plurality of safety systems for monitoring and controlling various safety equipment, including for controlling wellbore fluid (e.g., drilling fluid, formation fluid, etc.) within the wellbore 102. Such safety systems may comprise an MPD system 217, a well control (WC) system 218, and a choke pressure control (CPC) system 219.

The TH system 211 may comprise, for example, the support structure 112, the pipe rack 162, the THM 160, the catwalk 161, the slips 119, the power tongs 165, and/or other tubular handling equipment. The TH system 211 may perform tubular handling operations and serve as a support platform for tubular rotation equipment and a staging ground for rig operations, such as connection make up and break out operations.

The DSH system 212 may comprise, for example, the blocks 113, 115, the line 123, and the drawworks 118 for collectively hoisting the top drive 116 and the drill string 120 connected to the top drive 116. The DSH system 212 may perform drill string hoisting operations.

The DSR system 213 may comprise, for example, the top drive 116 and/or the rotary table and kelly. The DSR system 213 may perform drill string rotation operations.

The DFC system 214 may comprise, for example, the mud pumps 144, the bell nipple 139, the fluid container 142, the fluid conduits 146, 148, 158, and other drilling fluid circulation equipment. The DFC system 214 may be operable to pump and circulate the drilling fluid downhole through the drill string 120 and uphole through the wellbore annulus 108.

The DFP system 215 may comprise, for example, the drilling fluid cleaning and reconditioning equipment 170, the solids container 143, and the gas flare stack 174. The DFP system 215 may perform drilling fluid cleaning, reconditioning, and mixing operations.

The PS system 216 may comprise various sources of electrical power operable to power the well construction equipment of the well construction system 100, including the well construction equipment of the subsystems 211-219. The PS system 216 may also include various means for transferring and/or distributing electrical power and fuel to the well construction equipment and between various pieces of equipment of the PS system 216, including electrical power conductors, electrical connectors, electrical relays, fluid conductors, fluid connectors, and fluid valves, among other examples. The sources of electrical power may include combustion engine/electrical power generator units, solar/electrical power generation units, electrical power regeneration units, wind/electrical power generation units, electrical power grid, electrical power storage units (e.g., batteries, capacitors, etc.), and fuel storage devices, among other examples.

The MPD system 217 may comprise, for example, the RCD 138, the MPD manifold 152, and the fluid conduit 150. The RCD 138 may be operable to seal the wellbore annulus 108 from the atmosphere and direct the drilling fluid flowing out of the wellbore 102 though the MPD manifold 152 to control (i.e., restrict) the flow of the drilling fluid out of the wellbore 102 and, thus, apply back pressure to the upper end of the wellbore annulus 108. The RCD 138 permits the drill string 120 to rotate while sealing the wellbore annulus 108 to thereby permit MPD operations.

The WC system 218 may comprise the BOP stack 130, the annular preventer 132, the power unit 137, the BOP control workstation 151, and the BOP controller 153. The BOP equipment 130, 132 may be operable to seal the wellbore annulus 108 of the wellbore 102 from the atmosphere and, thus, direct the drilling fluid (and perhaps formation fluid) flowing out of the wellbore 102 through the ported adapter 136 and the CK manifold 156.

The CPC system 219 may comprise the CK manifold 156, the ported adapter 136, and the fluid conduit 154. The CK manifold 156 may be operable to control (i.e., restrict) the flow of the drilling fluid out of the wellbore 102 via the ported adapter 136 when one of the BOP equipment 130, 132 is closed to thereby apply back pressure to the upper end of the wellbore annulus 108 and, thus, facilitate control of annular pressure of the drilling fluid within the wellbore 102.

Each of the equipment subsystems 211-219 may further comprise various communication devices (e.g., modems, network interface cards, etc.) and communication lines (e.g., cables, conductors, etc.), communicatively connecting sensors and/or actuators of each subsystem 211-219 with a central controller 192 and a control workstation 197. Although the equipment listed above and shown in FIG. 1 is associated with certain subsystems 211-219 depicted in FIG. 2, such associations are merely examples that are not intended to limit or prevent such equipment from being associated with two or more subsystems 211-219 and/or different subsystems 211-219.

The equipment subsystems 211-219 may include various local controllers 221-229 (e.g., processing devices, computers, etc.), each operable to control various equipment of the corresponding subsystem 211-219 and/or an individual piece of equipment of the corresponding subsystem 211-219. Each subsystem 211-219 includes various equipment that may comprise corresponding actuators 241-249 for actuating such equipment to thereby facilitate performance of corresponding well construction operations. Each subsystem 211-219 may include various sensors 231-239 operable to generate or otherwise output sensor data (e.g., signals, information, measurements, etc.) indicative of operational status of the equipment of each subsystem 211-219 and/or indicative of environmental conditions associated with the equipment of each subsystem 211-219. Each local controller 221-229 may output control data (e.g., commands, signals, information, etc.) to one or more actuators 241-249 to perform corresponding actions of a piece of equipment or subsystem 211-219. Each local controller 221-229 may receive sensor data output by one or more sensors 231-239. Although the local controllers 221-229, the sensors 231-239, and the actuators 241-249 are each shown as a single block, it is to be understood that one or more of the local controllers 221-229, the sensors 231-239, and/or the actuators 241-249 may be or comprise a plurality of local controllers, sensors, and/or actuators, respectively.

The sensors 231-239 may include sensors utilized for operation of the various subsystems 211-219 of the well construction system 100. For example, the sensors 231-239 may include cameras, position sensors, speed sensors, acceleration sensors, pressure sensors, force sensors, temperature sensors, flow rate sensors, vibration sensors, electrical current sensors, electrical voltage sensors, resistance sensors, gesture detection sensors or devices, voice actuated or recognition devices or sensors, chemical sensors, exhaust sensors, and/or other examples. The sensor data may include signals, information, and/or measurements indicative of a property (i.e., a parameter) of or associated with a piece of equipment. The sensor data may be indicative of, for example, equipment operational status (e.g., on or off, percent load, up or down, set or released, etc.), equipment operational performance (e.g., flow rate, operational speed, position, pressure, etc.), drilling parameters (e.g., depth, hook load, torque, etc.), auxiliary parameters (e.g., vibration data, temperature, etc.), or environmental conditions (e.g., temperature, pressure, etc.). The acquired sensor data may include or be associated with a timestamp (e.g., date and/or time) indicative of when the sensor data has been acquired. The sensor data may also or instead be aligned with a depth or other drilling parameter.

The central controller 192, the control workstation 197, the local controllers 221-229, the sensors 231-239, and the actuators 241-249 may be communicatively connected. The central controller 192 and the control workstation 197 may be communicatively connected to or along a central communication network 202 (e.g., a data bus, a field bus, a wide-area-network (WAN), a local-area-network (LAN), etc.). The local controllers 221-229, the sensors 231-239, and the actuators 241-249 of the corresponding subsystems 211-219 may be communicatively connected to or along corresponding local communication networks 251-259 (e.g., a field bus, a LAN, etc.). Each local communication network 251-259 may be communicatively connected with the central communication network 202 to communicatively connect the central controller 192 and the control workstation 197 with the subsystems 211-219.

The rig control system 200 may comprise the control workstation 197, the central controller 192, the local controllers 221-226, and the sensors 231-236 collectively operable to facilitate central (e.g., manual or automated) and/or local control of the various actuators 241-246 (i.e., rig equipment) of the subsystems 211-216. The central communication network 202 may be a part of the rig control system 200. The subsystems 217-219 (i.e., the safety systems) may therefore be communicatively connected with the central controller 192, the control workstation 197, and the subsystems 211-216 of the rig control system 200 via the central communication network 202 to further facilitate central and local control of the various actuators 247-249 (i.e., safety equipment) of the subsystems 217-219.

The sensor data output by the sensors 231-239 of the subsystems 211-219 may be communicated to the central controller 192 and/or the local controllers 221-229. Similarly, control data output by the central controller 192 and/or the local controllers 221-229 may be communicated to the various actuators 241-249 of the subsystems 211-219, perhaps pursuant to predetermined programming, such as to facilitate well construction operations and/or other operations described herein. Although the central controller 192 is shown as a single device (i.e., a discrete hardware component), it is to be understood that the central controller 192 may be or comprise a plurality of controllers and/or other electronic control devices collectively operable to monitor and control operations (i.e., computational processes or methods) of the well construction system 100. The central controller 192 may be located within or form a portion of the control center 190, although a portion of the central controller 192 may instead be external to the control center 190.

The sensors 231-239 and the actuators 241-249 may be monitored and/or controlled by corresponding local controllers 221-229 and/or the central controller 192. For example, the central controller 192 may be operable to receive sensor data from the sensors 231-239 of the subsystems 211-219 in real-time, and to output real-time control data directly to the actuators 241-249 of the subsystems 211-219 based on the received sensor data. However, certain operations of the actuators 241-249 of each subsystem 211-219 may be controlled by a corresponding local controller 221-229, which may control the actuators 241-249 based on sensor data received from the sensors 231-239 of the corresponding subsystem 211-219 and/or based on control data received from the central controller 192.

The rig control system 200 may be a tiered control system, wherein control of the subsystems 211-219 of the well construction system 100 may be provided via a first tier formed by the local controllers 221-229 and a second tier formed by the central controller 192. The central controller 192 may facilitate control of one or more of the subsystems 211-219 at the level of each individual subsystem 211-219. For example, in the DFP system 215, sensor data may be fed into the local controller 225, which may respond to control the actuators 245. However, for control operations that involve multiple subsystems 211-219, the control may be coordinated through the central controller 192 operable to coordinate control of the equipment of two, three, four, or more (or each) of the subsystems 211-219. For example, coordinated control operations may include the control of downhole pressure during tripping. The downhole pressure may be affected by the DFC system 214 (e.g., pump rate) and the TH system 211 (e.g., tripping speed). Thus, when it is intended to maintain a certain downhole pressure during tripping, the central controller 192 may output control data to two or more of the participating subsystems 211-219.

As described above, the central controller 192 may control various operations of the subsystems 211-219 via analysis of the sensor data from one or more of the subsystems 211-219 to facilitate coordinated control between the subsystems 211-219. The central controller 192 may generate or otherwise output control data to coordinate operations of various equipment of the subsystems 211-219. The control data may include, for example, commands from rig personnel, such as turn on or turn off a pump, switch on or off a fluid valve, or update a physical property setpoint, among other examples. The local controllers 221-229 may each include a fast control loop that directly obtains sensor data and executes, for example, a control algorithm to output the control data. The central controller 192 may include a slow control loop to periodically obtain sensor data and output the control data.

The central controller 192 and the local controllers 221-229 may each or collectively operate to receive and store machine-readable and executable program code instructions (e.g., computer program code, algorithms, programmed processes or operations, etc.) on a memory device (e.g., a memory chip, a memory disk, etc.) and then execute the program code instructions to run, operate, or perform various processes for monitoring and/or controlling the equipment of the well construction system 100.

The central controller 192 may run (i.e., execute) a central control process 204 (e.g., a coordinated control process) and each local controller 221-229 may run a corresponding local control process. Two or more of the local controllers 221-229 may run their local control processes to collectively coordinate operations between the equipment of two or more of the subsystems 211-219. The control process 204 of the central controller 192 may operate as a mechanization manager of the rig control system 200, coordinating operational sequences of the equipment of the well construction system 100.

The well construction system 100 may also be operated manually by rig personnel 195 (e.g., a driller) via the control workstation 197. The control workstation 197 may be utilized to monitor, configure, control, and/or otherwise operate one or more of the subsystems 211-219 by the rig personnel 195. The control workstation 197 may be operable for entering or otherwise communicating control data (e.g., commands, signals, information, etc.) to the central controller 192 and the local controllers 221-229 by the rig personnel 195, and for displaying or otherwise communicating information from the central controller 192 and the local controllers 221-229 to the rig personnel 195. The control workstation 197 may be communicatively connected with the central controller 192 and/or the local controllers 221-229 via the communication networks 202, 251-259 and may be operable to receive sensor data from the sensors 231-239 and transmit control data to the central controller 192 and/or the local controllers 221-229 to control the actuators 241-249. Accordingly, the control workstation 197 may be utilized by the rig personnel 195 to monitor and control the actuators 241-249 and other portions of the subsystems 211-219 via the central controller 192 and/or local controllers 221-229.

During manual operation of the well construction system 100, the rig personnel may operate as the mechanization manager of the rig control system 200 by manually coordinating operations of various equipment, such as to achieve an intended operational status (or drilling state) of the well construction operations, including tripping in or drilling at an intended rate of penetration (ROP). The control process of each local controller 221-229 may facilitate a lower (e.g., basic) level of control within the rig control system 200 to operate a corresponding piece of equipment or a plurality of pieces of equipment of a corresponding subsystem 211-219. Such control process may facilitate, for example, starting, stopping, and setting or maintaining an operational speed of a piece of equipment. During manual operation of the well construction system 100, the rig personnel 195 manually controls the individual pieces of equipment to achieve the intended operational status of each piece of equipment.

During automatic or semi-automatic operation of the well construction system 100, the control process 204 of the central controller 192 may output control data directly to the actuators 241-249 to control the well construction operations. The control process 204 may also or instead output control data to the local control process of one or more local controllers 221-229, wherein each local control process may then output control data to the actuators 241-249 of the corresponding subsystem 211-219 to control a portion of the well construction operations performed by that subsystem 211-219. Thus, the control processes of the central controller 192 and the local controllers 221-229 of the rig control system 200 individually and collectively perform monitoring and control operations described herein, including monitoring and controlling well construction operations. The program code instructions forming the basis for the control processes described herein may comprise rules (e.g., algorithms) based on the laws of physics for drilling and other well construction operations, among other examples.

Each control process being run by the controllers 192, 221-229 of the rig control system 200 may receive and process (i.e., analyze) sensor data from the sensors 231-239 according to the program code instructions, and may output control data (i.e., control signals or information) to operate or otherwise control the actuators 241-249 of the equipment. The controllers 192, 221-229 within the scope of the present disclosure can include, for example, programmable logic controllers (PLCs), industrial computers (IPCs), personal computers (PCs), soft PLCs, variable frequency drives (VFDs), and/or other controllers or processing devices operable to store and execute program code instructions, receive sensor data, and output control data to cause operation of the equipment based on the program code instructions, sensor data, and/or control data.

The well construction system 100 further comprises a plurality of operational data sources 205 operable to output operational data indicative of or otherwise associated with various operational aspects of the well construction system 100 and/or well construction operations performed by the well construction system 100. Each operational data source 205 may be communicatively connected to the central communication network 202 to communicatively connect the operational data sources 205 with the central controller 192, the control workstation 197, and the subsystems 211-219 of the rig control system 200.

One or more of the operational data sources 205 and the local controllers 227-229 of the safety systems 217-219 may be communicatively connected with the rig control system 200 via corresponding fieldbus couplers (not shown). Such fieldbus couplers (e.g., PN/PN, DP/DP, etc.) may operate as network interfaces, communicatively connecting one or more of the operational data sources 205 and the local controllers 227-229 to the communication network 202 and, thus, communicatively connecting one or more of the operational data sources 205 and the local controllers 227-229 to the central controller 192 and/or the local controllers 221-226 of the rig control system 200. Accordingly, the BOP controller 228 may be communicatively connected with and operable to receive data (e.g., sensor data, control commands, etc.) output by one or more of the local controllers 227, 229 of the other safety systems 217, 219, the operational data sources 205, and the local controllers 221-226 of the subsystems 211-216.

Although the operational data sources 205 are shown as being external to the rig control system 200, one or more of the operational data sources 205 may be or form a portion of the rig control system 200. For example, one or more of the operational data sources 205 may be stored (i.e., recorded) and/or performed by the central controller 192 or other processing devices of the rig control system 200. Furthermore, although the operational data sources 205 are shown as being implemented as part of the well construction system 100, one or more of the operational data sources 205 may be external to the well construction system 100 and located remote from the wellsite 104. For example, one or more of the operational data sources 205 may be stored (i.e., recorded) and/or performed by a remote controller 260 (e.g., a processing device). The remote controller 260 may be communicatively connected to the communication network 202 and, thus, communicatively connected to one or more of the central controller 192, the local controllers 221-229, and the sensors 231-239. A remote control workstation 262 may be communicatively connected to the remote controller 260. The workstation 262 may be operable for entering or otherwise communicating control data (e.g., commands, signals, information, etc.) to the remote controller 260 and other equipment controllers (e.g., central controller 192, local controllers 221-229, etc.) by the rig personnel 195, and for displaying or otherwise communicating information from the remote controller 260 and other equipment controllers to the rig personnel 195. The remote controller 260 and the workstation 262 may comprise one or more features and/or modes of operation of the central controller 192 and the workstation 197, respectively, as described above.

The operational data sources 205 may comprise a data storage device operable to receive and store a well construction plan (or drilling plan) 206 for drilling and/or otherwise constructing a planned well. The well construction plan 206 may include well specifications, operational parameters, and other information indicative of the planned well and the well construction equipment of the well construction system 100. For example, the well construction plan 206 may include properties of the subterranean formation through which the planned well is to be drilled and otherwise constructed, the path (e.g., direction, curvature, orientation, etc.) along which the planned well is to be formed through the formation, the depth (e.g., true vertical depth (TVD) and/or measured depth (MD)) of the planned well, operational specifications (e.g., power output, weight, torque capabilities, speed capabilities, dimensions, size, etc.) of the well construction equipment (e.g., top drive, mud pumps, 144, downhole mud motor 184, etc.) that is planned to be used to construct the planned well, and/or specifications (e.g., diameter, length, weight, etc.) of tubulars (e.g., drill pipe) that are planned to be used to construct the planned well. The well construction plan 206 may include knowledge (e.g., efficiency of various parameters) learned from offset wells that have been drilled. Optimal parameters associated with the offset wells may then be used as the recommended parameters in a current well construction plan 206. The knowledge learned from the offset wells, including operation limits, such as maximum WOB, top drive speed (RPM), ROP, and/or tripping speed versus depth, may be applied and used as an operation limit within the well construction plan 206.

The well construction plan 206 may further include well construction operations schedule (e.g., order and/or time of well constriction operations) for a plurality of planned well construction tasks (i.e., well construction objectives) that are intended to be achieved to complete the well construction plan 206. Each planned task may comprise a plurality of operational sequences and may be performed by the well construction equipment to construct the planned well. A planned task may be or comprise drilling a predetermined portion or depth of the planned well, completing a predetermined portion or stage of drilling operations, drilling through a predetermined section of the subterranean formation, and performing a predetermined plurality of operational sequences, among other examples. Each operational sequence may comprise a plurality or sequence of physical (i.e., mechanical) operations (i.e., actions) performed by various pieces of well construction equipment. Example operational sequences may include operations of one or more pieces of the well construction equipment of the well construction system 100 described above in association with FIG. 1.

The well construction plan 206 may further include planned operational parameters of the well construction equipment during each planned stage, portion, sequence, task, and/or operation of the well construction operations, such as WOB, RPM, and ROP as a function of wellbore depth. The well construction plan 206 may further include a planned electrical power demand profile (or schedule) indicative of electrical power demand for performing or otherwise associated with each planned stage, portion, sequence, task, and/or operation of the well construction operations contained in the well construction plan 206. Thus, the planned electrical power demand profile may be or comprise a schedule (e.g., sequence or order) of expected electrical power demand levels for predetermined pieces of well construction equipment that are to be met to perform each planned stage, portion, sequence, task, and/or operation of the well construction operations. The planned electrical power demand profile may comprise information indicative of planned generation and/or distribution of electrical power generated by one or more pieces of electrical power generating equipment of the PS system 216 to the various well construction equipment of the well construction system 100, including the well construction equipment of the subsystems 211-219, such as to facilitate performance of the well construction operations pursuant to the well construction plan 206.

The information forming or otherwise from the well construction plan 206 may originate or be delivered in a paper form, whereby the rig personnel manually input such information into the data storage device containing the well construction plan 206. However, the information forming the well construction plan 206 may originate or be delivered in digital format, such that it can be directly loaded to or saved by the data storage device or plurality of data storage devices. The data storage device, or plurality of data storage devices, containing the well construction plan 206 may be communicatively connected to the central controller 192 such that the central controller 192 can receive and process (or analyze) the well construction plan 206. The well construction plan 206 may be analyzed programmatically by the central controller 192 without human intervention. The data storage device storing the well construction plan 206 may be directly or indirectly (e.g., via the communication network 202) communicatively connected with the central controller 192. The data storage device storing the well construction plan 206 may instead be or form a portion of the central controller 192. The central controller 192 may analyze the well construction plan 206 and generate or output control data to the local controllers 221-229 or directly to the actuators 241-249 to control the well construction equipment to cause, facilitate, or otherwise implement one or more aspects of methods and operations described herein.

The operational data sources 205 may comprise a processing device (e.g., a computer, a PLC, etc.) operable to receive and store machine-readable and executable program code instructions on a data storage device and then execute such program code instructions to run, operate, or perform an abnormal event detector 207 (e.g., an abnormal event detecting computer process), which may be operable to analyze or otherwise process the sensor data received from the sensors 231-239 and detect an abnormal event (e.g., status, condition, etc.) experienced by or otherwise associated with one or more pieces of well construction equipment, and/or an abnormal event experienced by or otherwise associated with a wellbore (e.g., the wellbore 102 shown in FIG. 1). The abnormal event detector 207 may be operable to detect the abnormal events based on the sensor data and output abnormal event data indicative of the detected abnormal event. The processing device performing the abnormal event detector 207 may be directly or indirectly (e.g., via the communication network 202) communicatively connected with the central controller 192 and operable to transmit the abnormal event data to the central controller 192 for analysis. The processing device performing the abnormal event detector 207 may instead be or form a portion of the central controller 192. One or more of the local controllers 221-229 may also execute program code instructions to execute a corresponding abnormal event detector 207 to detect a local abnormal event. The local controllers 221-229 may then transmit local abnormal event data indicative of the local abnormal event to the central controller 192 for analysis.

The central controller 192 and/or the local controllers 221-229 may be operable to automate the well construction equipment to perform well construction operations and change such well construction operations as operational parameters of the well construction operations change and/or when an abnormal event (e.g., state, condition, etc.) is detected during the well construction operations. For example, the control process 204 of the central controller 192 may then re-plan well construction tasks, operational sequences, and other processes based on the well construction plan 206, the detected abnormal events, and/or the condition of the well and/or the well construction equipment. The abnormal event detector 207 may be operable to detect an abnormal event based on the sensor data received from the sensors 231-239 and cause the predetermined operations to be performed or otherwise implemented to stop or mitigate the abnormal event or otherwise in response to the abnormal event, without manual control of the well construction equipment by the rig personnel via the control workstation 197. For example, the central controller 192 may be operable to make decisions related to selection of actions or sequences of operations that are to be implemented during the well construction operations and/or the manner (e.g., speed, torque, mechanical power, electrical power, etc.) in which such selected operational sequences are to be implemented to stop or mitigate a detected abnormal event.

An abnormal event may be or comprise an abnormal operational surface event experienced by surface equipment (e.g., the surface equipment 110 shown in FIG. 1) and/or an abnormal operational downhole event experienced by a drill string (e.g., the drill string 120 shown in FIG. 1). An example abnormal operational downhole event may include stick-slip, axial vibrations, lateral vibrations, rotational vibrations, and stuck drill pipe. The abnormal event may instead be or comprise an abnormal downhole fluid event experienced by a downhole fluid, such as wellbore fluid (e.g., drilling fluid, formation fluid, fracturing fluid, etc.) within the wellbore, and/or formation fluid within a subterranean formation (e.g., the subterranean formation 106 shown in FIG. 1) through which the wellbore extends. An abnormal downhole fluid event may comprise, for example, a sudden change (e.g., increase or decrease) in wellbore pressure and/or wellbore fluid volume. An example abnormal downhole fluid event may include underpressure of the formation fluid, overpressure of the formation fluid, influx of formation fluid, gains of the wellbore fluid, and losses of the wellbore fluid.

The operational data sources 205 may comprise a processing device (e.g., a computer, a PLC, etc.) operable to receive and store machine-readable and executable program code instructions on a data storage device and then execute such program code instructions to run, operate, or perform an operational state detector 208 (e.g., an operational state detecting computer process), which may be operable to analyze or otherwise process the sensor data received from the sensors 231-239 and detect a state (e.g., a status, a stage, etc.) of the well construction operations that the well construction system 100 is performing. The operational state detector 208 may then output operational state data indicative of the operational state of the well construction system 100. The processing device performing the operational state detector 208 may be directly or indirectly (e.g., via the communication network 202) communicatively connected with the central controller 192 and operable to transmit the operational state data to the central controller 192 for analysis. The processing device performing the operational state detector 208 may instead be or form a portion of the central controller 192. One or more of the local controllers 221-229 may also execute program code instructions to execute a corresponding operational state detector 208 to detect a local operational state. The local controllers 221-229 may then transmit local operational state data indicative of the local operational state to the central controller 192 for analysis. Operational states of the well construction system 100 may comprise, for example, drilling, tripping, circulating, and reaming, among others.

The central controller 192 and/or the local controllers 221-229 may be operable to automate the well construction equipment to perform well construction operations and change such well construction operations as operational parameters of the well construction operations change and/or when a change in operational state (e.g., state, condition, etc.) is detected during the well construction operations. For example, the control process 204 of the central controller 192 may then re-plan well construction tasks, operational sequences, and other processes based on the well construction plan 206, the detected operational state, and/or the condition of the well and/or the well construction equipment.

The operational data sources 205 may comprise a processing device (e.g., a computer, a PLC, etc.) operable to receive and store machine-readable and executable program code instructions on a data storage device and then execute such program code instructions to run, operate, or perform a pipe tally tracker 209 (e.g., a pipe tally tracking computer process). The pipe tally tracker 209 may be operable to track (i.e., determine and record) a pipe tally (i.e., a list or inventory) containing various attributes (e.g., physical characteristics or specifications) indicative of or otherwise associated with each tubular (e.g., drill pipe, drill collars, drill pipe stands, casing joints, etc.) stored, used, or otherwise located at the well construction system 100, including tubulars that have been received on the rig floor 114 and/or stored in the fingerboard 164 of the pipe rack 162. The processing device performing the pipe tally tracker 209 may be directly or indirectly (e.g., via the communication network 202) communicatively connected with the central controller 192 and operable to transmit the pipe tally tracker 209 to the central controller 192 for analysis. The processing device performing the pipe tally tracker 209 may instead be or form a portion of the central controller 192.

The pipe tally tracker 209 may track the pipe tally in preparation for drilling or running operations. The pipe tally may be updated as the tubulars are being retrieved from the wellbore 102. For example, the pipe tally tracker 209 may track length of the drill string 120 based on the pipe tally. The pipe tally tracker 209 may be operable to track position (e.g., depth, height, stickup height, etc.) of each tubular and/or connection joint connecting adjacent tubulars. The pipe tally tracker 209 may simultaneously update service records, length of the drill string 120, and/or position of each tubular and/or connection joint. The pipe tally tracker 209 may be operable to receive and record block position measurements indicative of the height of the travelling block 113 as the DSH system 212 moves the drill string 120 upward and/or downward into and/or out of the wellbore 102. The pipe tally tracker 209 may be further operable to keep track of location and physical characteristics (e.g., a measured length) of each tubular and/or connection joint that is deployed downhole as part of the drill string 120, retrieved to the wellsite surface 104 from the wellbore 102, and/or stored in a fingerboard 164. The pipe tally tracker 209 may be further operable to determine the stickup height of the drill string 120 based on the height of the travelling block 113 and the pipe tally. The stickup height may be or comprise a height that the stickup portion of the drill string 120 extends above the rig floor 114. The stickup portion may be or comprise a portion of a tubular of the drill string 120 that is gripped by the slips 119 that extends above the rig floor 114.

The pipe tally may comprise an identifier (e.g., an identification number, a serial number, an assigned number, etc.) of each tubular in association with various attributes of that tubular, such as location on the fingerboard 164, weight, diameter, length, type, and historical use, among other examples. The pipe tally tracker 209 may automatically record the identifier of each tubular as it is deployed into and withdrawn from the wellbore 102 to record the order in which each tubular is deployed into and withdrawn from the wellbore 102. Tallying of the tubulars may be facilitated by a reader (not shown) operable to read the identifier off of a tag (e.g., a radio frequency tag, a magnetic tag, a bar code, a label, etc.) (not shown) associated with each tubular, such as when each tubular is received on the rig floor 114 and/or when being deployed into and withdrawn from the wellbore 102. The identifier may then be received and stored by the pipe tally tracker 209 to form or update the pipe tally. The tallying of the tubulars may instead be facilitated by sensors (e.g., weight and/or length sensors) (not shown) operable to track location attributes of each tubular, including information indicating when each tubular is received on the rig floor 114 and/or when each tubular is deployed into and withdrawn from the wellbore 102. The tracked attributes may then be received and stored by the pipe tally tracker 209 in association with an identifier assigned to that tubular, to form or update the pipe tally.

The operational data sources 205 may comprise a processing device (e.g., a computer, a PLC, etc.) operable to receive and store machine-readable and executable program code instructions on a data storage device and then execute such program code instructions to run, operate, or perform an equipment health monitor 210 (e.g., an equipment health monitoring computer process). The health monitor 210 may be operable to receive and record sensor data indicative of operational status of various well construction equipment and predict, calculate, or otherwise determine operational health (e.g., operational condition, maintenance condition, remaining operational life, etc.) of such well construction equipment based on the sensor data. The processing device performing the health monitor 210 may be communicatively connected with the local controllers 221-229 of the subsystems 211-219 via the communication network 202 and the local communication networks 251-252, such as may permit the health monitor 210 to receive sensor data from the sensors 231-239 of the various equipment of the subsystems 211-219. The processing device performing the health monitor 210 may be directly or indirectly (e.g., via the communication network 202) communicatively connected with the central controller 192 and operable to transmit the determined operational health to the central controller 192 for further analysis and/or to the control workstation 197 to be viewed by the rig personnel. The processing device performing the health monitor 210 may instead be or form a portion of the central controller 192.

The health monitor 210 may be operable to determine operational health of various well construction equipment based on sensor data output by sensors 231-239 associated with such well construction equipment. The health monitor 210 may be operable to determine operational health of the well construction equipment by using or otherwise based on one or more operational health monitoring analytics (or theories).

For example, the health monitor 210 may be operable to determine (current) operational health of well construction equipment based on an operational quantity (or amount) of an operational parameter indicated by sensor data. The operational quantity may be tracked (i.e., recorded and determined) and continuously compared to a historical (i.e., past, recorded, or otherwise known) operational quantity baseline (or threshold) that is associated with a historical operational health. The operational quantity may also or instead be tracked and continuously compared to a historical operational quantity trend (or curve) that associates a progressively changing historical operational health with a progressively changing historical operational quantity. Both the historical operational quantity baseline and the historical operational quantity trend may be determined based on historical operational quantity records. Thus, operational health may be determined by comparing a current operational quantity to a historical operational quantity baseline or to a historical operational quantity trend and then estimating (e.g., interpolating, extrapolating, etc.) the operational health based on such comparison. For example, operational health may be determined based on a relative difference between the historical operational quantity baseline and the current operational quantity. The operational health may also or instead be determined by assuming that the operational health is the same as (or equal to) the historical operational health along the historical operational quantity trend that is associated with the historical operational quantity that is the same as the current operational quantity. Operational quantities may include, for example, a quantity (i.e., number) of hours a piece of equipment has been operating, a quantity of operational cycles (e.g., movements, rises, closures, rotations, etc.) that piece of equipment has performed, a cumulative (or total) distance that a piece of equipment has moved, and a cumulative distance that a piece of equipment has moved an object (e.g., a tubular, a drill string, a travelling block, etc.).

The health monitor 210 may also or instead be operable to determine operational health of well construction equipment based on performance based condition monitoring, which utilizes sensor data indicative of actions performed or otherwise caused by actuators 241-249 of a piece of equipment to generate or otherwise output performance based condition indicators. Such performance based condition indicators may then be utilized as a basis for determining operational health of the piece of equipment. Performance based condition indicators may be indicative of condition of each actuator 241-249 and/or other components facilitating each action performed by the piece of equipment. Performance based condition indicators may be utilized as a basis for predicting developing faults (i.e., operational problems, breakdowns, failures) before such faults have manifested themselves through visual and/or physical detection by rig personnel or a full stop (i.e., failure) of the well construction equipment. When a fault has progressed to a point at which it is detectable via audible noise or excessive temperature (e.g., too hot to touch), the equipment is approaching point of failure.

Performance based condition monitoring may utilize a bottom-up approach, which focuses on sensor data indicative of detailed operational states (e.g., physical states) of individual actuators 241-249 or other components causing or otherwise associated with each action performed by a piece of equipment. The health monitor 210 may utilize sensor data to predict or determine the condition of the piece of well construction equipment. For example, performance based condition monitoring may include recording sensor data for each sensor 231-239, actuator 241-249, and/or action of a piece of equipment, and analyzing or otherwise processing such sensor data to output performance based condition indicators to predict or determine condition of the piece of equipment. The health monitor 210 may determine (i.e., calculate, generate, etc.) the performance based condition indicators based on sensor data indicative of physical states during each action caused, performed, or otherwise facilitated by a corresponding actuator 241-249 or other part of a piece of well construction equipment. Sensor data may be further indicative of different points of measurement of the action performed. Sensor data may include, for example, position of a hydraulic cylinder or motor, hydraulic fluid pressure, pressure within an accumulator, flow generated by a pump, force generated by an actuator 241-249, and temperature of hydraulic fluid.

The health monitor 210 may determine the performance based condition indicators based further on control commands (e.g., control signals, sequence steps, control functions, etc.) generated or output by equipment controllers to the individual actuators 241-249 of the well construction equipment triggering or causing the intended actions. The use of control commands highlights performance of the actuators 241-249 in the overall process efficiency, thereby treating the actuator 241-249 performance independently of process parameters. The sensor data may be compared to the control commands to determine differences in performance between an action that has been intended, as indicated by the control commend, and an action that has been actually executed, as indicated by the sensor data. Control commands may initiate the action. Control commands may include, for example, control signals that are transmitted by an equipment controller (e.g., central controller devices 192 and local controllers 221-229) to a mechanical controller, such as a hydraulic valve, to operate a hydraulic actuator, or an electrical controller, such as a relay or VFD, to operate an electrical actuator.

The performance based condition indicators may be recorded. Current and historical performance based condition indicators may be analyzed systematically or in real-time over a period of time by the health monitor 210 to recognize changes or trends in performance (e.g., performance quality degradation) of individual actuators 241-249 or components. Such trends may be indicative of developing or potential faults, which may be repaired or otherwise addressed before failure or large reductions in performance can manifest. When at least one of the performance based condition indicators falls below a predetermined threshold, the health monitor 210 may then generate or output health condition information indicative of operational health of the piece of equipment and transmit such health condition information to one or more output devices (e.g., workstations 151, 197) for viewing by rig personnel, who may then implement maintenance operations to improve the operational health of such piece of equipment.

The operational data sources 205 may comprise a processing device (e.g., a computer, a PLC, etc.) operable to receive and store machine-readable and executable program code instructions on a data storage device and then execute such program code instructions to run, operate, or perform a communication network and sensor health monitor 203 (e.g., a communication network and sensor health monitoring computer process). The health monitor 203 may be operable to receive data (e.g., sensor data, control commands, etc.) transmitted via various communication networks (e.g., communication networks 202, 251-259, etc.) and monitor such data to predict, calculate, or otherwise determine operational health of the communication networks and sensors (e.g., sensors 231-239) connected to such communication networks. The processing device performing the health monitor 203 may be communicatively connected with the local controllers 221-229 of the subsystems 211-219 via the communication network 202 and the local communication networks 251-259, such as may permit the health monitor 210 to receive sensor data from the sensors 231-239 of the various equipment of the subsystems 211-219. The processing device performing the health monitor 203 may be directly or indirectly (e.g., via the communication network 202) communicatively connected with the central controller 192 and operable to transmit the determined operational health to the central controller 192 for further analysis and/or to the control workstation 197 to be viewed by the rig personnel. The processing device performing the health monitor 203 may instead be or form a portion of the central controller 192.

The communication network and sensor health monitor 203 may therefore be or comprise a fail-safe watchdog system operable to monitor the status of the communication networks 202, 251-259 (and other communication systems) and sensors 231-239 of the well construction system 100. For example, the health monitor 203 may be operable to determine operational health of sensors 237-239 and/or the communication networks 257-259 of one or more of the safety systems 217-219. The health monitor 203 may monitor quality of signals output by the sensors 231-239, including sensor activity, status, and/or data consistency to determine operational health of the sensors 231-239 and communication networks 202, 251-259. The health monitor 203 continuously checks operational health of the sensors 231-239 and the communication networks 202, 251-259 within the scope of the present disclosure and may be operable to facilitate alarms indicative of loss of operational health and/or stop operation of equipment of one or more of the subsystems 211-219 when loss of operational health is detected. The health monitor 203 may also permit safe restarting of equipment of one or more of the subsystems 211-219 after loss of operational health is remedied.

Figure 3:
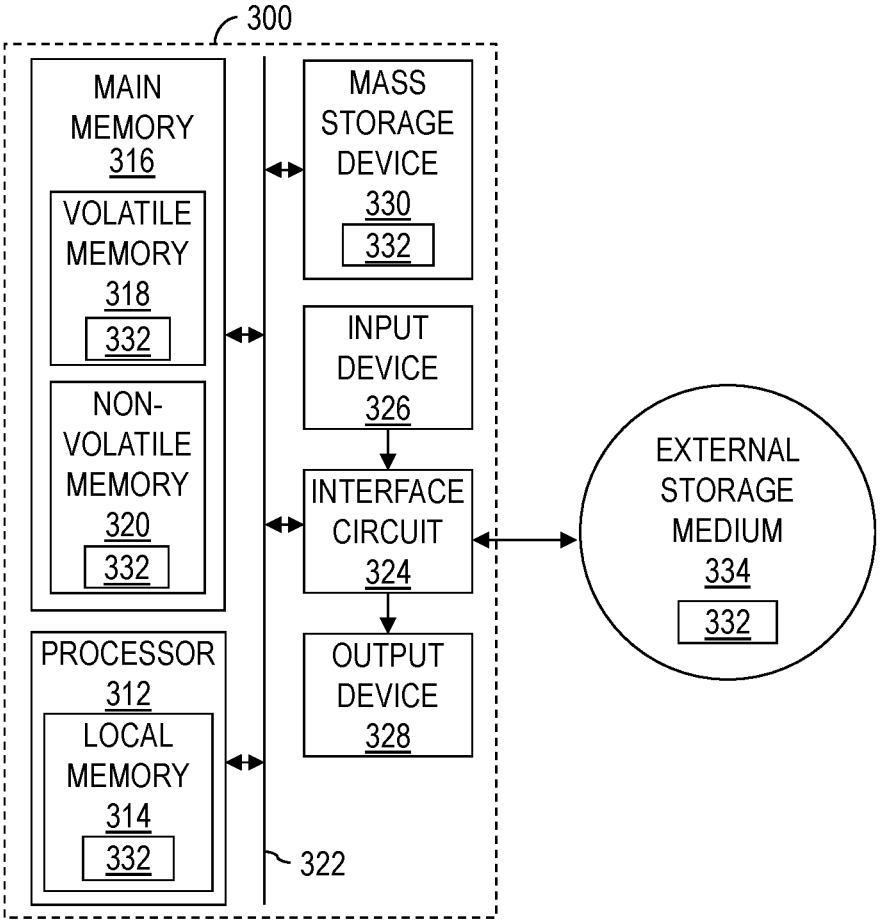
FIG. 3 is a schematic view of at least a portion of an example implementation of apparatus according to one or more aspects of the present disclosure.

FIG. 3 is a schematic view of at least a portion of an example implementation of a processing device (or system) 300 according to one or more aspects of the present disclosure. The processing device 300 may be or form at least a portion of one or more equipment controllers and/or other electronic devices shown in one or more of the FIGS. 1 and 2. For example, the processing device 300 may be or form at least a portion of one or more of the central controller 192, the local controllers 221-229, the control workstations 151, 197, the drilling plan 206, the abnormal event detector 207, the operational state detector 208, the pipe tally tracker 209, and the health monitor 210. Accordingly, the following description refers to FIGS. 1-3, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314, and may execute machine-readable and executable program code instructions 332 (i.e., computer program code) present in the local memory 314 and/or other memory device. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, embedded soft/hard processors in one or more FPGAs.

The processor 312 may execute, among other things, the program code instructions 332 and/or other instructions and/or programs to implement the example methods and/or operations described herein. For example, the program code instructions 332, when executed by the processor 312 of the processing device 300, may cause the processor 312 to receive and process (e.g., compare, analyze, etc.) sensor data (e.g., sensor measurements). The program code instructions 332, when executed by the processor 312 of the processing device 300, may also or instead output control data (i.e., control commands) to cause one or more portions or pieces of well construction equipment of a well construction system to perform the example methods and/or operations described herein. The program code instructions 332, when executed by the processor 312 of the processing device 300, may also or instead output information indicative of an event (e.g., abnormal event), a status (e.g., operational state, operational position, operational health, etc.), or a characteristic (e.g., size, length, height, etc.) of an object (e.g., a tubular), a piece of equipment, a well construction system, or otherwise at a wellsite to an output device (e.g., control workstation 197) for viewing by rig personnel.

The processor 312 may be in communication with a main memory 316, such as may include a volatile memory 318 and a non-volatile memory 320, perhaps via a bus 322 and/or other communication means. The volatile memory 318 may be, comprise, or be implemented by random-access memory (RAM), static RAM (SRAM), dynamic RAM (DRAM), synchronous DRAM (SDRAM), RAMBUS DRAM (RDRAM), and/or other types of RAM devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or other communication protocol.

One or more input devices 326 may also be connected to the interface circuit 324. The input devices 326 may permit a human user to enter the program code instructions 332, which may be or comprise control data, operational parameters, operational set-points, a well construction plan, and/or a database of operational sequences. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit visualization or other sensory perception of various data, such as sensor data, status data, and/or other example data. The output devices 328 may be, comprise, or be implemented by video output devices (e.g., a liquid crystal display (LCD), a light-emitting diode (LED) display, a cathode ray tube (CRT) display, a touchscreen, etc.), printers, and/or speakers, among other examples. The one or more input devices 326 and the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to systems and methods (e.g., operations and/or processes) for communicating with (e.g., monitoring, controlling, etc.) a BOP control system operable to monitor and control operation of BOP equipment at a wellsite. The systems of the present disclosure may comprise one or more instances of the apparatus (e.g., controllers 192, 221-229, workstations 151, 197, rig equipment 241-246, safety equipment 247-249, equipment systems or subsystems 211-219, etc.) shown in one or more of FIGS. 1-3, and/or otherwise within the scope of the present disclosure. Similarly, the methods of the present disclosure may be performed by utilizing (or otherwise in conjunction with) at least a portion of one or more implementations of one or more instances of the apparatus shown in one or more of FIGS. 1-3, and/or otherwise within the scope of the present disclosure. The methods may be caused to be performed, at least partially, by a controller (e.g., the control device 300, the central controller 192, the BOP controller 153, etc.) executing computer program code according to one or more aspects of the present disclosure. Thus, the present disclosure is also directed to a non-transitory, computer-readable medium comprising computer program code that, when executed by the controller, may cause such controller to perform the example methods described herein. The methods may also or instead be caused to be performed, at least partially, by rig personnel utilizing one or more instances of the apparatus shown in one or more of FIGS. 1-3, and/or otherwise within the scope of the present disclosure. Thus, the following description of example systems and/or methods refer to apparatus shown in one or more of FIGS. 1-3. However, the methods may also be performed in conjunction with implementations of apparatus other than those depicted in FIGS. 1-3 that are also within the scope of the present disclosure.

An example system for communicating with a BOP control system according to one or more aspects of the present disclosure may comprise the rig control system 200 for monitoring and controlling the rig equipment 241-246 operable to perform or otherwise facilitate drilling operations to drill the wellbore 201 at the wellsite 104. An example system for communicating with a BOP control system according to one or more aspects of the present disclosure may also or instead comprise a pressure control system for monitoring and controlling safety equipment (e.g., one or more of the pressure control manifolds 152, 156) fluidly connected with the wellbore 102.

The rig control system 200 may comprise the equipment controllers 192, 221-226 for controlling the rig equipment 241-246 and the sensors 231-236 operable to output rig data indicative of operational status of the rig equipment 241-246. For example, rig data may include position of the travelling block 113, which may be indicative of or otherwise used by the rig control system 200 to determine, for example, position (or height) of the drill string 120 within the wellbore 102, within the BOP equipment 130, 132, and above the rig floor 114, position of various portions (e.g., connection joints) of the drill string 120 within the wellbore 102, within the BOP equipment 130, 132, and above the rig floor 114, and length of the drill string 120 conveyed within the wellbore 102. As described above, the rig control system 200 may comprise the pipe tally tracker 209 or the rig control system 200 may instead be communicatively connected with the pipe tally tracker 209. Thus, the rig control system 200 may be operable to receive from the pipe tally tracker 209 pipe data indicative of the position of the drill string 120 within the wellbore 102, within the BOP equipment 130, 132, and above the rig floor 114, the position of various portions of the drill string 120 within the wellbore 102, within the BOP equipment 130, 132, and above the rig floor 114, and the length of the drill string 120 conveyed within the wellbore 102. The rig control system 200 may also or instead use the pipe data stored on the pipe tally tracker 209, including characteristics of the individual drill pipe 111, to determine the position of the drill string 120 within the wellbore 102, within the BOP equipment 130, 132, and above the rig floor 114, the position of various portions of the drill string 120 within the wellbore 102, within the BOP equipment 130, 132, and above the rig floor 114, and the length of the drill string 120 conveyed within the wellbore 102.

The pressure control system may comprise at least a portion of one or more of the MPD system 217 and the CPC system 219. For example, the pressure control system may be an MPD control system operable to control the MPD manifold 152. Such pressure control system may comprise the MPD controller 227 for controlling the MPD manifold 152 and the MPD sensors 237 operable to output pressure data associated with the MPD manifold 152 and indicative of wellbore pressure. The pressure control system may also or instead be a choke pressure control system operable to control the CK manifold 156. Such pressure control system may comprise the CK controller 227 for controlling the CK manifold 156 and the CK sensors 239 operable to output pressure data associated with the CK manifold 156 and indicative of the wellbore pressure. The pressure data may also or instead be indicative of hydraulic pressure applied to an actuator of the BOP equipment 130, 132 to close the BOP equipment 130, 132. For example, the pressure data may be indicative of hydraulic pressure generated by the power unit 137 and applied to the rams of the BOP stack 130 to actuate the rams to a closed position against the drill string 120 or applied to the annular packer of the annular preventer 132 to inflate the annular packer to a closed position against the drill string 120. Pressure data may also or instead be output by the abnormal event detector 207 and may include pressure data indicative of an impending or current abnormal surface or downhole event that can cause or has caused abnormal wellbore pressure. The sensors (e.g., the sensors 237 and/or the sensors 239) of a pressure control system (e.g., the MPD control system 217 and/or the CPC system 219) may be further operable to output flow rate data indicative of flow rate of wellbore fluid (e.g., drilling fluid, formation fluid, etc.) flowing uphole and out of the wellbore 102 to the wellbore surface 104.

The BOP control system within the scope of the present disclosure may be operable to monitor and control the BOP equipment 130, 132. The BOP control system may comprise at least a portion of the WC system 218. For example, the BOP control system may comprise the BOP controller 228 for controlling the BOP equipment 130, 132 and the BOP sensors 238 operable to output BOP data indicative of operational status of the BOP equipment 130, 132. The BOP control system may further comprise a BOP HMI (e.g., the BOP control workstation 151) usable by a human user to monitor and control the BOP equipment 130, 132. The BOP data may be indicative of closure status of the BOP equipment 130, 132, including whether one or more of the sets of rams of the BOP stack 130 or the annular packer of the annular preventer 132 are open or closed. Such closure status BOP data may be based on operator pressure data output by the BOP sensors 238 (e.g., pressure sensors) disposed in association with one or more of the BOP control unit 137 and the BOP equipment 130, 132. The operator pressure data may be indicative of hydraulic pressure generated by the power unit 137 and applied to the rams of the BOP stack 130 to actuate the rams to a closed position against the drill string 120 or applied to the annular packer of the annular preventer 132 to inflate the annular packer to a closed position against the drill string 120. The closure status BOP data may also or instead be based on ram position data output by the BOP sensors 238 (e.g., position sensors, proximity switches, Hall effect switches, etc.) disposed in association with one or more of the BOP control unit 137 and the BOP equipment 130, 132.

The BOP control system may be communicatively connected with the rig control system 200 and/or the pressure control system to thereby facilitate communication between the BOP control system, the rig control system 200, and the pressure control system. The BOP control system may be operable to receive the rig data and/or the pressure data from a corresponding one of the rig control system 200 and the pressure control system and display on the BOP HMI information based on the rig data and/or the pressure data. A human user viewing the information on the BOP HMI may then implement a course of action based on such information. For example, the human user may use the rig control workstation 197 to operate one or more of the rig equipment 241-247 in response to the viewed information. The human user may also or instead use the BOP HMI to control one or more of the BOP equipment 130, 132 in response to the viewed information.

The rig control system 200, the pressure control system, and/or the BOP control system may be operable to perform or otherwise facilitate alarm operations according to one or more aspects of the present disclosure, such as to alarm the human user (e.g., the driller or other rig personnel) of the BOP HMI of predetermined conditions and/or events. As described above, the rig control system 200 may comprise one or more of the sensors 231-236 operable to output rig data indicative of operational status of the rig equipment 241-246, the pressure control system may comprise one or more of the sensors 237, 239 operable to output pressure data indicative of wellbore pressure, and the BOP control system may comprise one or more of the sensors 238 operable to output BOP data indicative of operational status of the BOP equipment 130, 132. For example, when the pressure data indicates that the wellbore pressure is above a predetermined threshold and the BOP data indicates that BOP equipment 130, 132 is closed, the BOP control system may be operable to display on the BOP HMI information (e.g., an alarm, a warning, etc.) indicative of the wellbore pressure being above a predetermined threshold. Also, when the pressure data indicates that the wellbore pressure is above a predetermined threshold and the rig data indicates that a connection joint of the drill string 120 for performing the drilling operations is located between a set of rams of the BOP equipment 130, 132, the BOP control system may be operable to display on the BOP HMI information (e.g., an alarm, a warning, etc.) indicative of the wellbore pressure being above the predetermined threshold and/or display on the BOP HMI information indicative of the connection joint of the drill string 120 being located between the rams of the BOP equipment 130, 132.

The rig control system 200 and the BOP control system may also or instead be collectively operable to perform or otherwise facilitate alarm and interlock operations according to one or more aspects of the present disclosure, such as to prevent the human user of the rig control workstation 197 to cause performance of predetermined operations when predetermined conditions and/or events are taking place. For example, when the BOP data indicates that a set of rams of the BOP stack 130 is closed, the rig control system 200 may be operable to display on the rig control workstation 197 information indicative of the set of rams of the BOP stack 130 being closed and/or prevent the rig control workstation 197 from being used by the human user to operate the drawworks 118 to lift the drill string 120.

The rig control system 200 and the BOP control system may also or instead be collectively operable to perform or otherwise facilitate alarm and interlock operations according to one or more aspects of the present disclosure, such as to limit control of predetermined rig equipment by the human user via the rig control workstation 197 when predetermined conditions and/or events are taking place. For example, when the BOP data indicates that the annular preventer 132 is closed, the rig control system 200 may be operable to display on the rig control workstation 197 information indicative of the annular preventer 132 being closed and/or limit the use of the rig control workstation 197 by the human user to control the drawworks 118 to convey (e.g., raise or lower) the drill string 120 within the wellbore 102. For example, when the BOP data indicates that the annular preventer 132 is closed, the rig control system 200 may be operable to limit the rate (or speed) at which the drill string 120 is conveyed (or moved) by the drawworks 118, regardless of whether the human user of the control workstation 197 is attempting to convey the drill string 120 at a faster rate. Thus, during stripping operations when the drill string 120 is conveyed within the wellbore 102 while the annular preventer 132 is closed, a controller (e.g., the central controller, the local controller 222) of the rig control system 200 may limit the speed of the drawworks 118 to limit the rate at which the drill string 120 is conveyed within the wellbore, such as to reduce wear that is caused to the annular packer of the annular preventer 132.

The rig control system 200, the pressure control system, and the BOP control system may also or instead be collectively operable to perform or otherwise facilitate alarm and interlock operations according to one or more aspects of the present disclosure, such as to prevent the human user of the BOP HMI to cause performance of predetermined operations when predetermined conditions and/or events are taking place. For example, when the pressure data indicates that the wellbore pressure is above a predetermined threshold and the BOP data indicates that BOP equipment 130, 132 is closed, the BOP control system may be operable to display on the BOP HMI information indicative of the wellbore pressure being above the predetermined threshold and prevent the BOP HMI from being used by the human user to open the BOP equipment 130, 132. Furthermore, when the pressure data indicates that the wellbore pressure is above the predetermined threshold and the rig data indicates that a connection joint of the drill string 120 is located between a set of rams of the BOP equipment 130, 132, the BOP control system may be operable to: display on the BOP HMI information (e.g., an alarm, a warning, etc.) indicative of the wellbore pressure being above the predetermined threshold; display on the BOP HMI information indicative of the connection joint of the drill string 120 being located between the rams of the BOP equipment 130, 132; and prevent the BOP HMI from being used by the human user to open the rams of the BOP equipment 130, 132.

The rig control system 200, the pressure control system, and the BOP control system may also or instead be collectively operable to perform or otherwise facilitate alarm and interlock operations and request operation confirmation according to one or more aspects of the present disclosure, such as to prevent the human user of the BOP HMI from manually causing unintended performance of predetermined operations when predetermined conditions and/or events are taking place. For example, when the pressure data indicates that the wellbore pressure is above a predetermined threshold and the BOP data indicates that BOP equipment 130, 132 is closed, the BOP control system may be operable to: display on the BOP HMI information (e.g., an alarm, a warning, etc.) indicative of the wellbore pressure being above the predetermined threshold, prevent the BOP HMI from being used by the human user to open the BOP equipment 130, 132; display on the BOP HMI a request that the human user confirm via the BOP HMI that the wellbore pressure is above the predetermined threshold; and permit the BOP HMI to be used by the human user to open the BOP equipment 130, 132 after the human user has confirmed via the BOP HMI that the wellbore pressure is above the predetermined threshold. Such operations of the BOP control system may be performed during the drilling operations, such as when high wellbore pressure is caused by influx of formation fluid, and during BOP equipment testing operations, such as when the wellbore 102 is artificially pressurized and the BOP equipment 130, 132 is tested for intended functionality and fluid leaks.

The rig data may be further indicative of the size of drill pipe 111 of the drill string 120 used to perform the drilling operations and the BOP data may be further indicative of the size of each set of rams of the BOP equipment 130, 132. Such rig data and BOP data may be manually entered to a controller (e.g., central controller 192) of the rig control system 200 and/or a controller (e.g., local controller 228) of the BOP control system by a human user prior to drilling operations. Such rig data and BOP data may also or instead be output from the well construction plan 206 and/or the pipe tally tracker 209 and automatically pushed to and received by the controllers 192, 153 of the rig control system 200 and/or the BOP control system.

In an example implementation, when the pressure data indicates that the wellbore pressure is above a predetermined threshold, the BOP control system may be further operable to: display on the BOP HMI information (e.g., an alarm, a warning, etc.) indicative of the wellbore pressure being above the predetermined threshold; display on the BOP HMI a request that the human user select one of the sets of sealing rams of the BOP stack 130 to close; receive from the BOP HMI ram data indicative of the selected one of the sets of rams of the BOP stack 130 to close; and compare the size of the selected one of the sets of rams of the BOP stack 130 and the size of the drill pipe 111. When the size of the selected one of the sets of rams and the size of the drill pipe 111 match, the BOP control system may be further operable to cause the selected one of the sets of rams to close to seal the wellbore 102. However, when the size of the selected one of the sets of rams and the size of the drill pipe 111 do not match, the BOP control system may be further operable to display on the BOP HMI information indicative of the size of the selected one of the sets of rams not matching the size of the drill pipe 111. Also, when the size of the selected one of the sets of rams and the size of the drill pipe 111 do not match, the BOP control system may be operable to: display on the BOP HMI a request that the human user confirm via the BOP HMI that the size of the selected one of the sets of rams and the size of the drill pipe 111 match; and cause the selected one of the sets of rams to close after the human user has confirmed via the BOP HMI that the size of the selected one of the sets of rams and the size of the drill pipe 111 match. When the size of the selected one of the sets of rams and the size of the drill pipe 111 do not match, the BOP control system may also or instead be operable to: display on the BOP HMI a request that the human user enter ram data indicative of another one of the sets of rams to close; receive from the BOP HMI ram data indicative of the another one of the sets of rams to close; compare the size of the another one of the sets of rams and the size of the drill pipe 111; and, when the size of the another one of the sets of rams and the size of the drill pipe 111 match, cause the another one of the sets of rams to close to seal the wellbore 102.

In another example implementation, when the pressure data indicates that the wellbore pressure is above a predetermined threshold, the BOP control system may be further operable to: display on the BOP HMI information (e.g., an alarm, a warning, etc.) indicative of the wellbore pressure being above the predetermined threshold; display on the BOP HMI a request that the human user select a set of shear rams of the BOP stack 130 to close; receive from the BOP HMI shear ram data indicative of the selected set of shear rams of the BOP stack 130 to close; and compare the size of the selected set of shear rams of the BOP stack 130 and the size of the drill pipe 111. When the size of the selected set of shear rams and the size of the drill pipe 111 match, the BOP control system may be further operable to cause the selected set of shear rams to close to therefore shear (or cut) the drill string 120. However, when the size of the selected set of shear rams and the size of the drill pipe 111 do not match, the BOP control system may be further operable to display on the BOP HMI information indicative of the size of the selected set of shear rams not matching the size of the drill pipe 111. Also, when the size of the selected set of shear rams and the size of the drill pipe 111 do not match, the BOP control system may be operable to: display on the BOP HMI a request that the human user confirm via the BOP HMI that the size of the selected set of shear rams and the size of the drill pipe 111 match; and cause the selected set of shear rams to close after the human user has confirmed via the BOP HMI that the size of the selected set of shear rams and the size of the drill pipe 111 match. When the size of the selected set of shear rams and the size of the drill pipe 111 do not match, the BOP control system may also or instead be operable to: display on the BOP HMI a request that the human user enter ram data indicative of another set of shear rams to close; receive from the BOP HMI ram data indicative of the another set of shear rams to close; compare the size of the another set of shear rams and the size of the drill pipe 111; and, when the size of the another set of shear rams and the size of the drill pipe 111 match, cause the another set of shear rams to close to shear the drill string 120.

The rig control system 200, the pressure control system, and the BOP control system may also or instead be collectively operable to perform or otherwise facilitate alarm and interlock operations and request operation confirmation according to one or more aspects of the present disclosure, such as to prevent the BOP control system to automatically cause unintended performance of predetermined operations when predetermined conditions and/or events are taking place.

In an example implementation, when the pressure data indicates that the wellbore pressure is above a predetermined threshold, the BOP control system may be operable to: display on the BOP HMI information (e.g., an alarm, a warning, etc.) indicative of the wellbore pressure being above the predetermined threshold; select one of the sets of sealing rams of the BOP stack 130 to close; and compare the size of the selected one of the sets of rams and the size of the drill pipe 111. When the size of the selected one of the sets of rams and the size of the drill pipe 111 match, the BOP control system may cause the selected one of the sets of rams to close to seal the wellbore 102; and, when the size of the selected one of the sets of rams and the size of the drill pipe 111 do not match, the BOP control system may display on the BOP HMI information indicative of the size of the selected one of the sets of rams not matching the size of the drill pipe 111. Also, when the size of the selected one of the sets of rams and the size of the drill pipe 111 do not match, the BOP control system may be operable to: display on the BOP HMI a request that the human user confirm via the BOP HMI that the size of the selected one of the sets of rams and the size of the drill pipe 111 match; and cause the selected one of the sets of rams to close after the human user has confirmed via the BOP HMI that the size of the selected one of the sets of rams and the size of the drill pipe 111 match. When the size of the selected one of the sets of rams and the size of the drill pipe 111 do not match, the BOP control system may be operable to: display on the BOP HMI a request that the human user enter ram data indicative of another one of the sets of rams to close; receive from the BOP HMI ram data indicative of the another one of the sets of rams to close; compare the size of the another one of the sets of rams and the size of the drill pipe 111; and, when the size of the another one of the sets of rams and the size of the drill pipe 111 match, cause the another one of the sets of rams to close to seal the wellbore 102.

In another example implementation, when the pressure data indicates that the wellbore pressure is above a predetermined threshold, the BOP control system may be operable to: display on the BOP HMI information (e.g., an alarm, a warning, etc.) indicative of the wellbore pressure being above the predetermined threshold; select a set of shear rams of the BOP stack 130 to close; and compare the size of the selected set of shear rams and the size of the drill pipe 111. When the size of the selected set of shear rams and the size of the drill pipe 111 match, the BOP control system may cause the selected set of shear rams to close to shear (or cut) the drill string 120. When the size of the selected set of shear rams and the size of the drill pipe 111 do not match, the BOP control system may display on the BOP HMI information indicative of the size of the selected set of shear rams not matching the size of the drill pipe 111. Also, when the size of the selected set of shear rams and the size of the drill pipe 111 do not match, the BOP control system may be operable to: display on the BOP HMI a request that the human user confirm via the BOP HMI that the size of the selected set of shear rams and the size of the drill pipe 111 match; and cause the selected set of shear rams to close after the human user has confirmed via the BOP HMI that the size of the selected set of shear rams and the size of the drill pipe 111 match. When the size of the selected set of shear rams and the size of the drill pipe 111 do not match, the BOP control system may be operable to: display on the BOP HMI a request that the human user enter ram data indicative of another set of shear rams to close; receive from the BOP HMI ram data indicative of the another set of shear rams to close; compare the size of the another set of shear rams and the size of the drill pipe 111; and, when the size of the another set of shear rams and the size of the drill pipe 111 match, cause the another set of shear rams to close to shear the drill string 120.

In another example implementation, when the pressure data indicates that the wellbore pressure is above the predetermined threshold, the BOP data indicates that the rams of the BOP stack 130 are open, and the rig data indicates that a connection joint of the drill string 120 is located between a set of rams of the BOP stack 130, the BOP control system may be operable to: display on the BOP HMI information (e.g., an alarm, a warning, etc.) indicative of the wellbore pressure being above the predetermined threshold; display on the BOP HMI information indicative of the connection joint of the drill string 120 being located between the rams of the BOP stack 130; prevent the BOP HMI to be used by the human user to close the rams of the BOP stack 130; display on the BOP HMI a request that the human user cause the drawworks 118 to move (e.g., raise or lower) the drill string 120 to a position in which the connection joint of the drill string 120 is located away from (e.g., above or below) the rams of the BOP stack 130, such that the rams can close about a body portion of the drill string 120; display on the BOP HMI a request that the human user confirm via the BOP HMI that the drill string 120 has been repositioned such that the rams can close about the body portion of the drill string 120; and permit the BOP HMI to be used by the human user to close the rams of the BOP stack 130 after the human user has confirmed via the BOP HMI that the drill string 120 has been repositioned. However, the BOP control system may be operable to automatically cause the drawworks 118 to move the drill string 120 (e.g., via the rig control system) to a position in which the connection joint of the drill string 120 is located away from the rams of the BOP stack 130. The BOP control system may also or instead be operable to automatically cause the rams of the BOP stack 130 to close based on rig data that indicates that the drill string 120 has been repositioned and/or after the human user has confirmed via the BOP HMI that the drill string 120 has been repositioned.

In another example implementation, when the pressure data and/or the flow rate data is indicative of an influx of formation fluid into the wellbore 102 and the BOP data is indicative of the BOP equipment 130, 132 being open, the BOP control system may be operable to: display on the BOP HMI information (e.g., an alarm, a warning, etc.) indicative of the wellbore pressure and/or the uphole flow rate of the wellbore fluid being indicative of an influx of formation fluid; cause the annular preventer 132 to close about the drill string 120 automatically or after the human user has caused, via the BOP HMI, the annular preventer 132 to close about the drill string 120. The BOP control system may be operable to: receive rig data indicative of the size (e.g., diameter) of the drill string 120 and, based on programing and the size of the drill string 120, determine operator pressure (e.g., hydraulic pressure) generated by the power unit 137 that is to be applied to the annular packer of the annular preventer 132 to inflate the annular packer to the closed position against the drill string 120. For example, a smaller sized drill string 120 may result in a higher operator pressure to be applied to the annular packer to seal the wellbore 102 and a larger sized drill string 120 may result in a lower operator pressure to be applied to the annular packer to seal the wellbore 102. Furthermore, during stripping operations, the BOP control system may be operable to: receive rig data indicative of the size of the drill string 120 and, based on programing and the size of the drill string 120, change the operator pressure generated by the power unit 137 that is to be applied to the annular packer of the annular preventer 132 as the size of the drill string 120 changes to seal the wellbore 102.

In still another example implementation, when the pressure data and/or the flow rate data is indicative of an influx of formation fluid into the wellbore 102, the MPD system 217 is operating (e.g., the RCD 138 is closed and the wellbore fluid is flowing through the MPD manifold 152), and the BOP data indicates that the BOP equipment 130, 132 is open, the BOP control system may be operable to: display on the BOP HMI information (e.g., an alarm, a warning, etc.) indicative of the wellbore pressure and/or the uphole flow rate of the wellbore fluid being indicative of an influx of formation fluid and cause the MPD system 217 to initiate MPD control to increase wellbore pressure (e.g., by restricting flow through the MPD manifold 152). The BOP control system may monitor the uphole flow rate of the wellbore fluid (e.g., flow through the MPD manifold 152) until influx of the formation fluid is suppressed (e.g., flow rate decreases below a predetermined threshold) or a predetermined maximum wellbore pressure threshold is reached. The BOP control system may then be operable to display on the BOP HMI information (e.g., an alarm, a warning, etc.) indicative of the wellbore pressure having reached the predetermined maximum wellbore pressure threshold and initiate closure of the BOP equipment 130, 132. The BOP control system may then be operable to: display on the BOP HMI a request that the human user confirm via the BOP HMI that the size of the selected one of the sets of rams and the size of the drill pipe 111 match; and cause the selected one of the sets of rams to close after the human user has confirmed via the BOP HMI that the size of the selected one of the sets of rams and the size of the drill pipe 111 match. However, the BOP control system may instead automatically confirm that the size of the selected one of the sets of rams and the size of the drill pipe 111 match. The BOP control system may then be operable to initiate standpipe pressure control operations and cause the CPC system 219 to circulate the influx through the choke and kill lines of the CK manifold 156.

The BOP control system may be programmed with a logic path (i.e., an algorithm) that, when executed by the BOP control system, may cause the BOP control system to perform predetermined operations. An example logic path may include defining a predetermined pressure threshold indicative of high wellbore pressure. Then, when the BOP equipment 130, 132 is operated (manually or automatically) to an open position and the wellbore pressure exceeds the predetermined pressure threshold by a predetermined amount (e.g., percent), the BOP control system may activate (e.g., display on the BOP HMI) an alarm (e.g., displayed information) indicative of high wellbore pressure. If no action (manual or automatic) is taken by the human user or by the BOP control system, the BOP control system may activate interlock operations to prevent opening (manual or automatic) of the BOP equipment 130, 132. However, if the wellbore pressure is vented (manually or automatically) such that the wellbore pressure is below the predetermined pressure threshold by a predetermined amount, the BOP control system may request that the human user confirm opening of the BOP equipment 130, 132. After the human user has confirmed the opening of the BOP equipment 130, 132, the BOP control system may cause the BOP equipment 130, 132 to open.

Other example logic path may include defining a predetermined pressure threshold indicative of high wellbore pressure, receiving by the BOP control system information indicative of configuration of the BOP equipment 130, 132, such as sizes of the rams of the BOP stack 130, and receiving from the rig control system 200 information indicative of the size of the drill pipe 111 forming the drill string 120. Then, when the BOP equipment 130, 132 is operated (manually or automatically) to a closed position and if the wellbore pressure exceeds the predetermined pressure threshold, the BOP control system may activate (e.g., display on the BOP HMI) an alarm (e.g., displayed information) indicative of the high wellbore pressure. The human user may manually select or the BOP control system may automatically select a set of rams of the BOP stack 130 to close. The BOP control system may then compare (or validate) the size of the drill pipe 111 to the size of the set of rams that are being operated (manually or automatically) to the closed position. If the size of the drill pipe 111 does not match the size of the selected set of rams that are being operated to the closed position, the BOP control system may activate (e.g., display on the BOP HMI) an alarm indicating to the human user that the size of the drill pipe 111 does not match the size of the selected set of rams. The BOP control system may then request via the BOP HMI that the human user confirm (or validate) that the sizes match or operate another set of rams that match the size of the drill pipe 111. However, if the size of the drill pipe 111 matches the size of the selected set of rams that are being operated to the closed position, the BOP control system may operate the selected set of rams to the closed position.

The BOP control system may also or instead be communicatively connected with a health monitoring system (e.g., the health monitor 210) to thereby facilitate communication between the BOP control system and the health monitoring system. The health monitoring system may be operable to receive the BOP data, record the BOP data to a memory, and determine operational health of the BOP equipment 130, 132 based on the BOP data. The health monitoring system may be communicatively connected to the rig control system 200 or the health monitoring system may be or form at least a portion of the rig control system 200. Thus, the health monitoring system may be communicatively connected with the BOP control system via the rig control system 200.

The health monitoring system may be operable to determine (current) operational health of the BOP equipment 130, 132 based on an operational quantity (or amount) of an operational parameter indicated by the BOP data in a manner described above with respect to the health monitor 210. As described above, the BOP data may be indicative of closure status of the BOP equipment 130, 132, including whether one or more of the sets of rams of the BOP stack 130 or the annular packer of the annular preventer 132 are open or closed. The quantity of closures may be tracked and continuously compared to a historical baseline or a historical trend (or curve). Thus, operational health may be determined by comparing a current number of closures to the historical baseline or the historical trend and then estimating (e.g., interpolating, extrapolating, etc.) the operational health based on such comparison. The operational health of the BOP equipment 130, 132 may also or instead be determined based on performance based condition monitoring of the BOP data in a manner described above with respect to the health monitor 210.

The health monitoring system may be further operable to transmit BOP health data indicative of the determined operational health of the BOP equipment 130, 132 to the BOP control system and the BOP control system may be further operable to display on the BOP HMI health information based on the BOP health data. The health information displayed on the BOP HMI may be indicative of low operational health, including operational health that is approaching or is below a predetermined threshold. A human user viewing the health information on the BOP HMI may then implement a course of action based on such health information. For example, the human user may use the control workstation 197 to operate one or more of the rig equipment 241-247 in response to the viewed health information. The human user may also or instead use the BOP HMI to operate one or more of the BOP equipment 130, 132 in response to the viewed health information. The human user may also or instead schedule or implement maintenance operations to mitigate or otherwise improve the low operational health of the BOP equipment 130, 132.

As described above, the BOP control system may also be communicatively connected with the rig control system 200 to thereby facilitate communication between the BOP control system and the rig control system 200, and one or more sensors 231-236 of the rig control system 200 may be operable to output rig data indicative of operational status of the rig equipment 241-246. The health monitoring system may be operable to receive the rig data, record the rig data to a memory, and determine operational health of the BOP equipment 130, 132 based on the rig data.

The health monitoring system may be operable to determine operational health of the BOP equipment 130, 132 based on an operational quantity of an operational parameter indicated by the rig data and BOP data in a manner described above with respect to the health monitor 210. The operational health of the BOP equipment 130, 132 may also or instead be determined based on performance based condition monitoring of the rig data and BOP data in a manner described above with respect to the health monitor 210. As described above, the rig data may be indicative of length of a drill pipe 111 conveyed within the wellbore 102 and BOP data may be indicative of closure status of the BOP equipment 130, 132. The health monitoring system may thus be operable to: record the rig data to the memory, determine the length of drill pipe 111 conveyed within the wellbore 102 while the annular preventer 132 is closed based on the BOP data and the rig data; and determine operational health of the annular preventer 132 based on the determined length of drill pipe 111 that is stripped within the wellbore 102 (i.e., conveyed within the wellbore 102 while the annular preventer 132 is closed). During such stripping operations, the annular packer of the annular preventer is experiencing wear. Length (or footage) of the drill string 120 stripped or the quantity of connection joints stripped may be tracked and continuously compared to a historical baseline or a historical trend by the health monitoring system. Thus, operational health (i.e., amount of wear) of the annular packer may be determined by comparing a current length of the drill string stripped or a current quantity of connection joints stripped to the historical baseline or the historical trend and then estimating the operational health based on such comparison.

As described above, the BOP control system may be communicatively connected with the pressure control system to thereby facilitate communication between the BOP control system and the pressure control system, and one or more sensors 237, 239 of the pressure control system may be operable to output pressure data indicative of the wellbore pressure. The health monitoring system may be operable to receive the pressure data and BOP data, record the pressure data and the BOP data to a memory, and determine operational health of the BOP equipment 130, 132 based on the pressure data and BOP data.

The health monitoring system may be operable to determine operational health of the BOP equipment 130, 132 based on an operational quantity of an operational parameter indicated by the pressure data and BOP data in a manner described above with respect to the health monitor 210. The operational health of the BOP equipment 130, 132 may also or instead be determined based on performance based condition monitoring of the pressure data and BOP data in a manner described above with respect to the health monitor 210. As described above, the pressure data may be indicative of wellbore pressure and the BOP data may be indicative of closure status of the BOP equipment 130, 132. The health monitoring system may thus be operable to: record the pressure data to the memory, determine wellbore pressure while the BOP equipment 130, 132 is closed based on the pressure data and BOP data; and determine operational health of the annular preventer 132 based on amount of time or instances when the BOP equipment 130, 132 has been closed and the wellbore pressure has been high. When the BOP equipment 130, 132 is closed and the wellbore pressure is high, ram packers (or bonnet seals) of the BOP stack 130 and an annular packer (or seal) of the annular preventer 132 are stressed and, thus, experience wear. The amount of time or instances when the BOP equipment 130, 132 has been closed and the wellbore pressure has been high may be tracked and continuously compared to a historical baseline or a historical trend by the health monitoring system. Thus, operational health (i.e., amount of wear) of the ram packers and the annular packer may be determined by comparing a current amount of time or instances when the BOP equipment 130, 132 has been closed and the wellbore pressure has been high to the historical baseline or the historical trend and then estimating the operational health based on such comparison.

Figure 4:
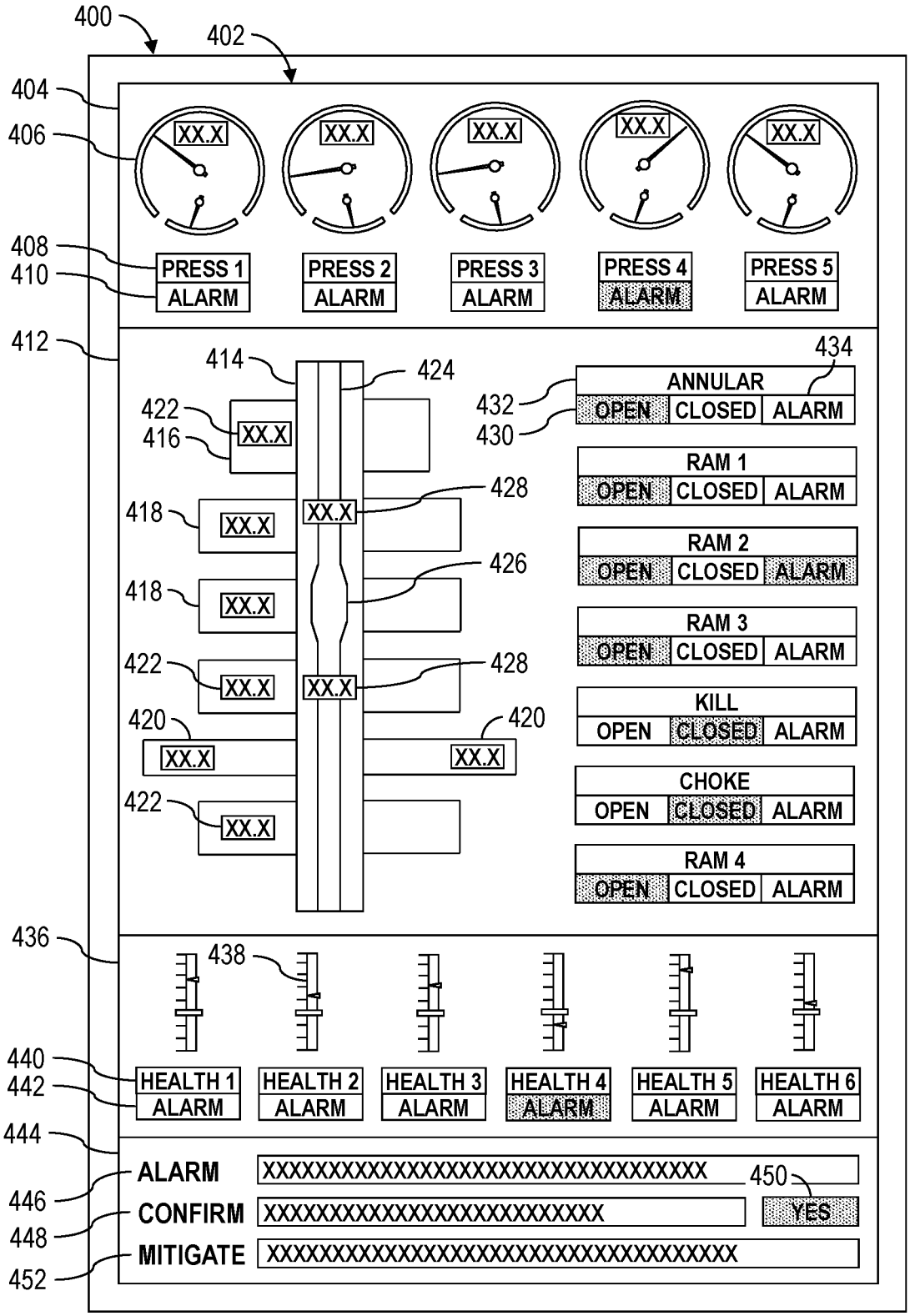
FIG. 4 is a schematic view of at least a portion of an example implementation of apparatus according to one or more aspects of the present disclosure.

FIG. 4 is an example implementation of a display screen 402 that may be generated by a processing device (e.g., the processing device 300, the BOP controller 153, etc.) and displayed by a video output device (e.g., a display monitor, a touchscreen, etc.) of a BOP HMI 400 (e.g., the BOP control workstation 151) for monitoring and controlling the BOP equipment 130, 132. The BOP HMI 400 may be part of the BOP control system communicatively connected with the rig control system 200 and/or the pressure control system. The following description refers to FIGS. 1-4, collectively.

The BOP control system may be operable to receive pressure data from the pressure control system and display on the BOP HMI 400 pressure information based on the pressure data. For example, the display screen 402 may comprise a pressure status area (or window) 404 displaying pressure information 406 indicative of wellbore pressure. The pressure information 406 indicative of wellbore pressure may be based on pressure data output by one or more of the MPD sensors 237 and CK sensors 239. The pressure status area 404 may also or instead display pressure information 406 indicative of operator (e.g., hydraulic) pressure output by the BOP control unit 137 for operating (or actuating) the BOP equipment 130, 132. The pressure information 406 indicative of operator pressure may be based on pressure data output by BOP sensors 238 disposed in association with one or more of the BOP control unit 137 and the BOP equipment 130, 132. The pressure information 406 may comprise or be displayed in the form of numerical values, tables, graphs, bars, gauges, lights, and/or schematics, among other examples. The pressure status area 404 may also display location information 408 displayed in association with the pressure information 406 and describing the location of the pressure sensor facilitating the corresponding pressure information 406 or otherwise describing the source of the corresponding pressure information 406. The pressure status area 404 may also display alarm (or event) information 410 displayed in association with the pressure information 406 and indicating presence of an abnormal (e.g., high) pressure. The alarm information 410 may activate (e.g., light up, change color, appear, etc.) based on the pressure data output by one or more of the pressure sensors 237, 238, 239, such as when wellbore pressure and/or operator pressure is above or below a predetermined threshold. The alarm information 410 may also or instead activate based on information output by the abnormal event detector 207, including information indicative of an impending or current abnormal surface or downhole event that can cause or has caused abnormal wellbore pressure.

The display screen 402 displayed on the BOP HMI 400 may comprise an operational status area (or window) 412 displaying BOP information based on BOP data and indicative of operational status of the BOP equipment 130, 132. For example, the BOP information displayed in the operational status area 412 may comprise virtual (or software) BOP equipment 414 representing the BOP equipment 130, 132 of the well construction system 100. The virtual BOP equipment 414 may indicate the physical configuration of the BOP equipment 130, 132. For example, the virtual BOP equipment 414 may include a virtual annular preventer 416, virtual rams 418, and virtual CK valves 420 representing corresponding portions of the BOP equipment 130, 132. The BOP information displayed in the operational status area 412 may also comprise BOP characteristics information 422 indicative of physical characteristics (e.g., model, size, etc.) of the BOP equipment 130, 132, including the annular preventer 416, the rams 418, and CK valves 420. The BOP characteristics information 422 may comprise or be displayed in textual and/or numerical form and in association with a corresponding portion of the virtual BOP equipment 414, such as to indicate the physical characteristics of the BOP equipment 130, 132. The virtual BOP equipment 414 and the BOP characteristics information 422 may therefore collectively indicate physical characteristics of the BOP equipment 130, 132 and the relative position of the annular preventer 132, the rams of the BOP stack 130, and the CK valves (e.g., connected with the ported adapter 136).

The BOP control system may be operable to receive rig data from the rig control system 200 and display on the BOP HMI 400 rig information based on the rig data and indicative of operational status of predetermined rig equipment 241-246. Such rig information may be displayed in the operational status area 412. For example, the rig information displayed in the operational status area 412 may comprise conveyance status information 424 indicative of whether the drill string 120 extends through the BOP equipment 130, 132. The rig information may also or instead comprise connection joint status information 426 indicative of whether a connection joint of the drill string 120 is positioned between one of the rams of the BOP stack 130 or within the annular preventer 132. The rig information displayed in the operational status area 412 may comprise a virtual (or software) drill string 424 representing the drill string 120 of the well construction system 100. The virtual drill string 424 may indicate the physical configuration of the drill string 120. For example, the virtual drill string 424 may include virtual portions of the drill string 120, including a virtual connection joint 426 representing a connection joint of the drill string 120. The virtual drill string 424 may be shown positioned with respect to the virtual BOP equipment 414 in a manner that reflects the position of the drill string 120 with respect to the BOP equipment 130, 132. For example, the virtual connection joint 426 may be shown positioned with respect to the virtual annular preventer 416, the virtual rams 418, and/or the virtual CK valves 420 in a manner that reflects the position of a connection joint of the drill string 120 with respect to the same portion of the BOP equipment 130, 132. Thus, the virtual BOP equipment 414 and the virtual drill string 424 may indicate if the drill string 120 extends through the BOP equipment 130, 132 and whether a connection joint of the drill string 120 is positioned between a set of rams of the BOP stack 130 or within the annular preventer 132. The rig information displayed in the operational status area 412 may also comprise drill string characteristics information 428 indicative of physical characteristics (e.g., model, outside diameter, length, etc.) of a portion (or drill pipe) of the drill string 120 located within the BOP equipment 130, 132. The drill string characteristics information 428 may comprise or be displayed in textual and/or numerical form and in association with a corresponding portion of the virtual drill string 424, such as to indicate the physical characteristics of a corresponding portion of the drill string 120 located within the BOP equipment 130, 132. The virtual drill string 424 and the drill string characteristics information 428 may therefore collectively indicate physical characteristics of the drill string 120 and the relative position of the drill string 120 with respect to the annular preventer 132, the rams of the BOP stack 130, and the CK valves.

The BOP information displayed in the operational status area 412 may further comprise closure status information 430 indicative of closure status (i.e., open or closed) of the BOP equipment 130, 132. The closure status information 430 may comprise or be displayed in textual and/or numerical form and in association with a corresponding portion of the virtual BOP equipment 414, such as to indicate the closure status of a corresponding portion (e.g., set of rams) of the BOP equipment 130, 132. Each instance of the closure status information 430 may activate (e.g., appear, light up, change color, etc.) to indicate whether the rams of the BOP stack 130, the annular preventer 132, and/or the CK valves 420 are in the open position or in the closed position. Each instance of the closure status information 430 may operate as a virtual (or software) button, which may be operated (e.g., touched, clicked on, etc.) by the human user to cause the HMI 400 to output (or transmit) a control command to the BOP controller 153 and/or the BOP control unit 137 to cause the annular preventer 132, a corresponding set of rams of the BOP stack 130, and a corresponding one of the CK valves 420 to either close or open. Each instance of the closure status information 430 may activate to visually confirm or otherwise indicate to the human user the current position of the annular preventer 132, the current position of the rams of the BOP stack 130, and the current position of the CK valves 420. The operational status area 412 may also display location information 432 displayed in association with the closure status information 430 and describing the portion of the BOP equipment 130, 132 corresponding to the closure status information 430. The operational status area 412 may also display alarm (or event) information 434 displayed in association with the closure status information 430 and indicating presence of an abnormal condition. For example, the alarm information 434 may activate (e.g., light up, change color, appear, etc.) when a connection joint of the drill string 120 is positioned between a set of rams of the BOP stack 130 and that set of rams is attempted to be closed automatically by the BOP controller 153 or manually by the human user of the BOP HMI 400.

The display screen 402 may comprise a health status area (or window) 436 displaying health information 438 indicative of operational health of the BOP equipment 130, 132, including one or more of operational condition, maintenance condition, and remaining operational life of the BOP equipment 130, 132. For example, the health information 438 may comprise one or more of current total (or cumulative) runtime (or operating time) with respect to a predetermined threshold runtime, remaining runtime until maintenance is planned to be performed, and projected remaining operational life of a corresponding component or portion of the BOP equipment 130, 132. Components or portions of the BOP equipment 130, 132 may include, for example, the annular packer of the annular preventer 132 and the ram packers of the BOP ram stack 130. The health information 438 may be based on BOP health data output by the health monitoring system (e.g., the health monitor 210). The health information 438 may comprise or be displayed in the form of numerical values, tables, graphs, bars, gauges, lights, and/or schematics, among other examples. The health status area 436 may also display location information 440 displayed in association with the health information 438 describing the name and/or location of the monitored component or portion of the BOP equipment 130, 132. For example, the location information 440 may indicate or refer to a specific set of rams of the BOP stack 130 or a portion of the annular preventer 132. The health status area 436 may also display alarm (or event) information 442 displayed in association with the health information 438. The alarm information 442 may activate (e.g., light up, change color, appear, etc.) to indicate to the human user that operational health of a corresponding component or portion of the BOP equipment 130, 132 comprises low operational health or is approaching low operational health. The alarm information 442 may also or instead activate based on information output by the abnormal event detector 207, such as information indicative of an impending or current abnormal surface or downhole event that can cause or has caused low operational health of the BOP equipment 130, 132.

The display screen 402 may comprise an alarm (or event) description area (or window) 444 displaying alarm information 446 describing active (or triggered) alarms related to the BOP equipment 130, 132, as described above. For example, the alarm information 446 may describe that a connection joint of the tool string 120 is located between a set of rams of the BOP stack 130 that the human user or the BOP controller 153 is attempting to close. The alarm information 446 may describe that pressure at the upper end (i.e., under the BOP equipment 130, 132) of the wellbore 102 is high. The alarm information 446 may describe which component or portion if the BOP equipment 130, 132 is experiencing low operational health. The alarm description area 444 may display confirmation information 448 requesting that the human user confirm that the human user is aware of the conditions that activated the alarm and/or that the human user wants to proceed with subsequent operations of the BOP equipment in spite of the conditions that activated the alarm or after such conditions have been mitigated. The display screen 402 may comprise a virtual (or software) button 450 in association with the confirmation information 448. The virtual button 450 may be operated (e.g., touched, clicked on, etc.) by the human user to confirm that the human user is aware of the alarm and/or that the human user wants to proceed with subsequent operations of the BOP equipment. For example, the confirmation information 448 may indicate to the human user a request to confirm that the human user is aware of high wellbore pressure and/or that the human user wishes to proceed with opening of the BOP equipment 130, 132 in spite of such high pressure or after such high pressure has been mitigated. The confirmation information 448 may indicate to the human user a request to confirm that the human user is aware of the low operational health of the BOP equipment 130, 132 and/or that the human user wishes to proceed with opening of the BOP equipment 130, 132 despite such low operational health or after such low operational health has been mitigated. The alarm description area 444 may further display mitigation information 452 describing counteractive measures (i.e., corrective actions or operations) that may be performed or otherwise implemented by rig personnel (e.g., the human user of the BOP HMI) that may mitigate the conditions that activated the alarm. Such mitigating actions may include operating a specified piece of equipment, including a specific portion (e.g., a ram, a valve, etc.) of the BOP equipment or perform maintenance to the BOP equipment 103, 132 associated with the alarm. For example, the mitigation information 452 may suggest that the rig personnel (e.g., the driller) first bleed off the high wellbore pressure before opening the BOP equipment 130, 132. The mitigation information 452 may suggest that the rig personnel (e.g., the driller) first raise the drill string 120 before closing a set of rams of the BOP stack 130.

In view of the entirety of the present disclosure, including the figures and the claims, a person having ordinary skill in the art will readily recognize that the present disclosure introduces a system comprising: a pressure control system for controlling a pressure control manifold fluidly connected with a wellbore, wherein the pressure control system comprises a sensor operable to output pressure data indicative of wellbore pressure; and a BOP control system for controlling BOP equipment. The BOP control system comprises: a sensor operable to output BOP data indicative of operational status of the BOP equipment; and a BOP HMI usable by a human user to monitor and control the BOP equipment. The BOP control system: is communicatively connected with the pressure control system; receives the pressure data; and displays, on the BOP HMI, information based on the pressure data.

The pressure control system may comprise at least one of: a CK pressure control system for controlling a CK manifold; and an MPD control system for controlling an MPD manifold.

In response to the pressure data being indicative of the wellbore pressure being above a predetermined threshold and the BOP data being indicative of the BOP equipment being closed, the BOP control system may display, on the BOP HMI, information indicating that the wellbore pressure is above the predetermined threshold.

In response to the pressure data being indicative of the wellbore pressure being above a predetermined threshold and the BOP data being indicative of the BOP equipment being closed, the BOP control system may: display, on the BOP HMI, information indicating that the wellbore pressure is above the predetermined threshold; and prevent the BOP HMI from being used by the human user to open the BOP equipment.

In response to the pressure data being indicative of the wellbore pressure being above a predetermined threshold and the BOP data being indicative of the BOP equipment being closed, the BOP control system may: display, on the BOP HMI, information indicating that the wellbore pressure is above the predetermined threshold; prevent the BOP HMI from being used by the human user to open the BOP equipment; display, on the BOP HMI, a request that the human user confirm that the wellbore pressure is above the predetermined threshold; and permit the BOP HMI to be used by the human user to open the BOP equipment after the human user has confirmed, via the BOP HMI, that the wellbore pressure is above the predetermined threshold.

The present disclosure also introduces a system comprising: a rig control system for controlling rig equipment operable to perform drilling operations to drill a wellbore at a wellsite, wherein the rig control system comprises a plurality of sensors operable to output rig data indicative of operational status of the rig equipment; a pressure control system for controlling a pressure control manifold fluidly connected with the wellbore, wherein the pressure control system comprises a sensor operable to output pressure data indicative of wellbore pressure; and a BOP control system for controlling BOP equipment. The BOP control system comprises: a sensor operable to output BOP data indicative of operational status of the BOP equipment; and a BOP HMI usable by a human user to monitor and control the BOP equipment. The BOP control system: is communicatively connected with the rig control system and the pressure control system; receives the rig data and the pressure data; and displays, on the BOP HMI, information based on the rig data and the pressure data.

The pressure control system may comprise at least one of: a CK pressure control system for controlling a CK manifold; and an MPD control system for controlling an MPD manifold.

In response to the pressure data being indicative of the wellbore pressure being above a predetermined threshold and the BOP data being indicative of the BOP equipment being closed, the BOP control system may display, on the BOP HMI, information indicating that the wellbore pressure is above the predetermined threshold.

In response to the pressure data being indicative of the wellbore pressure being above a predetermined threshold and the BOP data being indicative of the BOP equipment being closed, the BOP control system may: display, on the BOP HMI, information indicating that the wellbore pressure is above the predetermined threshold; and prevent the BOP HMI from being used by the human user to open the BOP equipment.

In response to the pressure data being indicative of the wellbore pressure being above a predetermined threshold and the rig data being indicative of a connection joint of a drill string for performing the drilling operations being located between rams of the BOP equipment, the BOP control system may display on the BOP HMI: information indicating that the wellbore pressure is above the predetermined threshold; and information indicating that the drill string connection joint is located between the rams of the BOP equipment.

In response to the pressure data being indicative of the wellbore pressure being above a predetermined threshold and the rig data being indicative of a connection joint of a drill string for performing the drilling operations being located between rams of the BOP equipment, the BOP control system may: display, on the BOP HMI, information indicating that the wellbore pressure is above the predetermined threshold; display, on the BOP HMI, information indicating that the drill string connection joint is located between the rams of the BOP equipment; and prevent the BOP HMI from being used by the human user to open the rams of the BOP equipment.

The rig data may be further indicative of a size of drill pipe forming a drill string for performing the drilling operations, the BOP data may be further indicative of a size of each set of rams of the BOP equipment, and, in response to the pressure data being indicative of the wellbore pressure being above a predetermined threshold, the BOP control system may: display, on the BOP HMI, information indicating that the wellbore pressure is above the predetermined threshold; select one of the sets of rams to close; compare the size of the selected set of rams and the drill pipe size; in response to the size of the selected set of rams matching the drill pipe size, cause the selected set of rams to close; and in response to the size of the selected set of rams not matching drill pipe size, display on the BOP HMI information indicating that the size of the selected set of rams does not match the drill pipe size.

The rig data may be further indicative of a size of drill pipe forming a drill string for performing the drilling operations, whereas the BOP data may be further indicative of a size of each set of rams of the BOP equipment. In response to the pressure data being indicative of the wellbore pressure being above a predetermined threshold, the BOP control system may: display, on the BOP HMI, information indicating that the wellbore pressure is above the predetermined threshold; display, on the BOP HMI, a request that the human user select one of the sets of rams to close; receive, from the BOP HMI, ram data indicative of the user-selected set of rams to close; compare the size of the selected set of rams and the drill pipe size; in response to the size of the selected set of rams matching the drill pipe size, cause the selected set of rams to close; and in response to the size of the selected set of rams not matching the drill pipe size, display on the BOP HMI information indicating that the size of the selected set of rams and the drill pipe size do not match.

The present disclosure also introduces a system comprising: a BOP control system for controlling BOP equipment at a wellsite, wherein the BOP control system comprises a sensor operable to output BOP data indicative of operational status of the BOP equipment; and a health monitoring system communicatively connected with the BOP control system. The health monitoring system: records the BOP data to a memory; and determines operational health of the BOP equipment based on the BOP data.

The BOP control system may comprise a BOP HMI usable by a human user to monitor and control the BOP equipment, the health monitoring system may transmit BOP health data indicative of the determined operational health of the BOP equipment to the BOP control system, and the BOP control system may display, on the BOP HMI, information based on the BOP health data.

The BOP data may be indicative of closure status of the BOP equipment.

The system may comprise a rig control system for controlling rig equipment operable to perform drilling operations to drill a wellbore at the wellsite, wherein the rig control system may comprise a sensor operable to output rig data indicative of operational status of the rig equipment, the BOP data may be indicative of closure status of an annular preventer of the BOP equipment, the rig data may be indicative of a length of drill string conveyed within the wellbore, and the health monitoring system may be further operable to: record the rig data to the memory; determine the length of drill string conveyed within the wellbore while the annular preventer is closed based on the BOP data and the rig data; and determine operational health of the annular preventer based on the determined drill string length conveyed within the wellbore while the annular preventer is closed.

The system may comprise a pressure control system for controlling a pressure control manifold fluidly connected with the wellbore. The pressure control system may comprise a sensor operable to output pressure data indicative of wellbore pressure, the BOP data may be indicative of closure status of the BOP equipment, and the health monitoring system may be operable to: while the BOP equipment is closed, record the pressure data to the memory; and determine operational health of the BOP equipment based further on the recorded pressure data. The pressure control system may comprise at least one of: a CK pressure control system for controlling a CK manifold; and an MPD control system for controlling an MPD manifold.

The BOP data may be indicative of at least one of: closure status of the BOP equipment; and/or hydraulic pressure applied to an actuator portion of the BOP equipment to close the BOP equipment.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A system comprising:

a pressure control system of a rig control system for controlling a pressure control manifold fluidly connected with a wellbore and movement of a drill string in a wellbore at a wellsite via at least a drawworks, wherein an annulus is formed between the drill string and the wellbore, and wherein the pressure control system comprises a sensor operable to output pressure data indicative of wellbore pressure in the annulus; and a blowout preventer (BOP) control system for controlling BOP equipment, wherein:

the BOP equipment comprises one or more preventers;

the BOP control system comprises:

a sensor operable to output BOP data indicative of operational status of the BOP equipment; and a BOP human-machine interface (HMI) usable by a human user to monitor and control the BOP equipment; and the BOP control system:

is communicatively connected with the pressure control system of the rig control system;

receives the pressure data; and displays, on the BOP HMI, responsive to the pressure data being indicative of trapped pressure in the annulus, information warning of the trapped pressure prior to allowing opening of one of the one or more preventers by the BOP control system.

2. The system of claim 1 wherein the pressure control system comprises one or more of:

a choke and kill (CK) pressure control system for controlling a CK manifold; and a managed pressure drilling (MPD) control system for controlling an MPD manifold.

3. The system of claim 1 wherein, in response to the pressure data being indicative of the wellbore pressure in the annulus being above a predetermined threshold and the BOP data being indicative of the one of the one or more preventers being closed, the BOP control system displays, on the BOP HMI, information indicating that the wellbore pressure in the annulus is above the predetermined threshold.

4. The system of claim 1 wherein, in response to the pressure data being indicative of the wellbore pressure in the annulus being above a predetermined threshold and the BOP data being indicative of the one of the one or more preventers being closed, the BOP control system:

displays, on the BOP HMI, information indicating that the wellbore pressure in the annulus is above the predetermined threshold; and prevents the BOP HMI from being used by the human user to open the one of the one or more preventers.

5. The system of claim 1 wherein, in response to the pressure data being indicative of the wellbore pressure in the annulus being above a predetermined threshold and the BOP data being indicative of the one of the one or more preventers being closed, the BOP control system:

displays, on the BOP HMI, information indicating that the wellbore pressure in the annulus is above the predetermined threshold;

prevents the BOP HMI from being used by the human user to open the one of the one or more preventers;

displays, on the BOP HMI, a request that the human user confirm that the wellbore pressure in the annulus is above the predetermined threshold; and permits the BOP HMI to be used by the human user to open the one of the one or more preventers after the human user has confirmed, via the BOP HMI, that the wellbore pressure in the annulus is above the predetermined threshold.

6. A system comprising:

a rig control system for controlling rig equipment operable to perform drilling operations to drill a wellbore at a wellsite, wherein the rig equipment comprises a drawworks, wherein the rig control system comprises a plurality of sensors operable to output rig data indicative of operational status of the rig equipment and a location of one or more connection joints of a drill string, and wherein the rig control system operatively controls speed of the drill string via the drawworks;

a pressure control system for controlling a pressure control manifold fluidly connected with the wellbore, wherein the pressure control system comprises a sensor operable to output pressure data indicative of wellbore pressure; and a blowout preventer (BOP) control system for controlling BOP equipment, wherein:

the BOP control system comprises:

a sensor operable to output BOP data indicative of operational status of the BOP equipment; and a BOP human-machine interface (HMI) usable by a human user to monitor and control the BOP equipment;

the BOP control system:

is communicatively connected with the rig control system and the pressure control system;

receives the rig data and the pressure data; and displays, on the BOP HMI, information based on the rig data and the pressure data; and the rig control system receives BOP data for control of speed of the drill string via the drawworks and the BOP control system receives rig data indicative of the location of the one or more connection joints of the drill string for control of the BOP equipment.

7. The system of claim 6 wherein the pressure control system comprises one or more of:

a choke and kill (CK) pressure control system for controlling a CK manifold; and a managed pressure drilling (MPD) control system for controlling an MPD manifold.

8. The system of claim 6 wherein, in response to the pressure data being indicative of the wellbore pressure being above a predetermined threshold and the BOP data being indicative of the BOP equipment being closed, the BOP control system displays, on the BOP HMI, information indicating that the wellbore pressure is above the predetermined threshold.

9. The system of claim 6 wherein, in response to the pressure data being indicative of the wellbore pressure being above a predetermined threshold and the BOP data being indicative of the BOP equipment being closed, the BOP control system:

displays, on the BOP HMI, information indicating that the wellbore pressure is above the predetermined threshold; and prevents the BOP HMI from being used by the human user to open the BOP equipment.

10. The system of claim 6 wherein, in response to the pressure data being indicative of the wellbore pressure being above a predetermined threshold and the rig data being indicative of one of the one or more connection joints of the drill string for performing the drilling operations being located between rams of the BOP equipment, the BOP control system displays on the BOP HMI:

information indicating that the wellbore pressure is above the predetermined threshold; and information indicating that the one of the one or more connection joints is located between the rams of the BOP equipment.

11. The system of claim 6 wherein, in response to the pressure data being indicative of the wellbore pressure being above a predetermined threshold and the rig data being indicative of one of the one or more connection joints of the drill string for performing the drilling operations being located between rams of the BOP equipment, the BOP control system:

displays, on the BOP HMI, information indicating that the wellbore pressure is above the predetermined threshold;

displays, on the BOP HMI, information indicating that the one of the one or more connection joints is located between the rams of the BOP equipment; and prevents the BOP HMI from being used by the human user to close the rams of the BOP equipment.

12. The system of claim 6 wherein:

the rig data are further indicative of a size of drill pipe forming the drill string for performing the drilling operations;

the BOP data are further indicative of a size of each set of rams of the BOP equipment; and in response to the pressure data being indicative of the wellbore pressure being above a predetermined threshold, the BOP control system:

displays, on the BOP HMI, information indicating that the wellbore pressure is above the predetermined threshold;

selects one of the sets of rams to close;

compares the size of the selected set of rams and the drill pipe size;

in response to the size of the selected set of rams matching the drill pipe size, causes the selected set of rams to close; and in response to the size of the selected set of rams not matching drill pipe size, displays on the BOP HMI information indicating that the size of the selected set of rams does not match the drill pipe size.

13. The system of claim 6 wherein:

the rig data are further indicative of a size of drill pipe forming the drill string for performing the drilling operations;

the BOP data are further indicative of a size of each set of rams of the BOP equipment;

in response to the pressure data being indicative of the wellbore pressure being above a predetermined threshold, the BOP control system:

displays, on the BOP HMI, information indicating that the wellbore pressure is above the predetermined threshold;

displays, on the BOP HMI, a request that the human user select one of the sets of rams to close;

receives, from the BOP HMI, ram data indicative of the user-selected set of rams to close;

compares the size of the selected set of rams and the drill pipe size;

in response to the size of the selected set of rams matching the drill pipe size, causes the selected set of rams to close; and in response to the size of the selected set of rams not matching the drill pipe size, displays on the BOP HMI information indicating that the size of the selected set of rams and the drill pipe size do not match.

14. A system comprising:

a blowout preventer (BOP) control system for controlling BOP equipment at a wellsite that comprises a wellbore, wherein the BOP control system comprises a sensor operable to output BOP data indicative of operational status of the BOP equipment, wherein the BOP equipment comprises an annular preventer; and a health monitoring system communicatively connected with the BOP control system, wherein the health monitoring system:

records the BOP data to a memory;

determines operational health of the BOP equipment based on the BOP data; and determines operational health of the annular preventer based on a determined drill string length conveyed within the wellbore while the annular preventer is closed.

15. The system of claim 14 wherein:

the BOP control system comprises a BOP human-machine interface (HMI) usable by a human user to monitor and control the BOP equipment;

the health monitoring system transmits BOP health data indicative of the determined operational health of the BOP equipment to the BOP control system; and the BOP control system displays, on the BOP HMI, information based on the BOP health data.

16. The system of claim 14 wherein the BOP data are indicative of closure status of the BOP equipment.

17. The system of claim 14 further comprising a rig control system for controlling rig equipment operable to perform drilling operations to drill the wellbore at the wellsite, wherein:

the rig control system comprises a sensor operable to output rig data indicative of operational status of the rig equipment;

the BOP data are indicative of closure status of the annular preventer of the BOP equipment;

the rig data are indicative of a length of the drill string conveyed within the wellbore; and the health monitoring system is further operable to:

record the rig data to the memory; and determine the length of drill string conveyed within the wellbore while the annular preventer is closed based on the BOP data and the rig data to determine the operational health of the annular preventer based on the determined drill string length conveyed within the wellbore while the annular preventer is closed.

18. The system of claim 14 further comprising a pressure control system for controlling a pressure control manifold fluidly connected with the wellbore, wherein:

the pressure control system comprises a sensor operable to output pressure data indicative of wellbore pressure;

the BOP data are indicative of closure status of the BOP equipment; and the health monitoring system is further operable to:

while the BOP equipment is closed, record the pressure data to the memory; and determine operational health of the BOP equipment based further on the recorded pressure data.

19. The system of claim 18 wherein the pressure control system comprises one or more of:

a choke and kill (CK) pressure control system for controlling a CK manifold; and a managed pressure drilling (MPD) control system for controlling an MPD manifold.

20. The system of claim 14 wherein the BOP data are indicative of one or more of:

closure status of the BOP equipment; and hydraulic pressure applied to an actuator portion of the BOP equipment to close the BOP equipment.

* * * * *